US010584466B2

(12) United States Patent
Izumikawa

(10) Patent No.: US 10,584,466 B2
(45) Date of Patent: Mar. 10, 2020

(54) SHOVEL AND METHOD OF CONTROLLING SHOVEL

(71) Applicant: SUMITOMO(S.H.I.) CONSTRUCTION MACHINERY CO., LTD., Tokyo (JP)

(72) Inventor: Takeya Izumikawa, Chiba (JP)

(73) Assignee: SUMITOMO (S.H.I.) CONSTRUCTION MACHINERY CO., LTD., Tokyo (JP)

( * ) Notice: Subject to any disclaimer, the term of this patent is extended or adjusted under 35 U.S.C. 154(b) by 80 days.

(21) Appl. No.: 15/621,278

(22) Filed: Jun. 13, 2017

(65) Prior Publication Data

US 2017/0275854 A1 Sep. 28, 2017

Related U.S. Application Data

(63) Continuation of application No. PCT/JP2015/084976, filed on Dec. 14, 2015.

(30) Foreign Application Priority Data

Dec. 16, 2014 (JP) ..... 2014-254050

(51) Int. Cl.
*E02F 9/26* (2006.01)
*E02F 9/28* (2006.01)
*E02F 3/43* (2006.01)

(52) U.S. Cl.
CPC ..... *E02F 9/267* (2013.01); *E02F 3/431* (2013.01); *E02F 9/2808* (2013.01); *E02F 9/2883* (2013.01)

(58) Field of Classification Search
CPC ..... E02F 3/431; E02F 9/2808; E02F 9/2883; E02F 9/267
USPC ..... 701/34.4
See application file for complete search history.

(56) References Cited

U.S. PATENT DOCUMENTS 8,843,282 B2 * 9/2014 Atkinson ..... E02F 3/434 701/50
8,844,174 B2 * 9/2014 Hren ..... E02F 3/4075 292/217
2006/0042734 A1 3/2006 Turner et al.
(Continued)

FOREIGN PATENT DOCUMENTS

JP H05-071259 U 9/1993
JP H07-299726 11/1995
(Continued)

OTHER PUBLICATIONS

International Search Report for PCT/JP2015/084976 dated Jan. 26, 2016.

*Primary Examiner* — Atul Trivedi
(74) *Attorney, Agent, or Firm* — IPUSA, PLLC

(57) ABSTRACT

A shovel includes a lower-part traveling body, an upper-part turning body, an attachment, and a controller. The upper-part turning body is turnably mounted on the lower-part traveling body. The attachment is mounted on the upper-part turning body, and has a consumable part attached to its leading edge. The controller is configured to obtain coordinates of the consumable part when the consumable part is caused to contact a predetermined feature, and to calculate the amount of wear of the consumable part based on at least two sets of the coordinates obtained under different conditions.

21 Claims, 14 Drawing Sheets

(56) References Cited

U.S. PATENT DOCUMENTS

| | | | | |
|---|---|---|---|---|
| 2012/0263566 | A1* | 10/2012 | Taylor | E02F 3/437<br>414/694 |
| 2012/0330517 | A1* | 12/2012 | Ota | E02F 3/3411<br>701/50 |
| 2013/0049935 | A1 | 2/2013 | Miller | |
| 2013/0261904 | A1* | 10/2013 | Linstroth | E02F 9/265<br>701/50 |
| 2014/0200776 | A1 | 7/2014 | Matsuyama et al. | |
| 2017/0356167 | A1* | 12/2017 | Paul | E02F 9/2891 |
| 2017/0370058 | A1* | 12/2017 | Herrera | E01H 5/02 |
| 2019/0218753 | A1* | 7/2019 | Morimoto | E02F 3/34 |

FOREIGN PATENT DOCUMENTS

| | | | |
|---|---|---|---|
| JP | H09-253979 | 9/1997 | |
| JP | 2001-098585 | 4/2001 | |
| WO | 2013/032420 | 3/2013 | |
| WO | 2014/093625 | 6/2014 | |
| WO | WO-2014093625 A1 * | 6/2014 | E02F 3/20 |

* cited by examiner

SHOVEL AND METHOD OF CONTROLLING SHOVEL

CROSS-REFERENCE TO RELATED APPLICATIONS

The present application is a continuation application filed under 35 U.S.C. 111(a) claiming benefit under 35 U.S.C. 120 and 365(c) of PCT International Application No. PCT/JP2015/084976, filed on Dec. 14, 2015 and designating the U.S., which claims priority to Japanese Patent Application No. 2014-254050, filed on Dec. 16, 2014. The entire contents of the foregoing applications are incorporated herein by reference.

BACKGROUND

Technical Field

The present invention relates to shovels including a machine guidance device and methods of controlling a shovel.

Description of Related Art

An excavating blade for excavators whose wear limit can easily be determined by sight is known.

SUMMARY

According to an aspect of the present invention, a shovel includes a lower-part traveling body, an upper-part turning body, an attachment, and a controller. The upper-part turning body is turnably mounted on the lower-part traveling body. The attachment is mounted on the upper-part turning body, and has a consumable part attached to its leading edge. The controller is configured to obtain coordinates of the consumable part when the consumable part is caused to contact a predetermined feature, and to calculate the amount of wear of the consumable part based on at least two sets of the coordinates obtained under different conditions.

DETAILED DESCRIPTION

The excavating blade according to related art, however, while being capable of presenting a time for replacement, cannot accurately present how much wear has progressed. Therefore, to use machine guidance based on the accurate length of the excavating blade, an operator of the excavator has to manually measure the length of the excavating blade and input information on the measured value to a machine guidance device, which takes time and effort. When the excavating blade is worn, accurate machine guidance cannot be used unless such cumbersome work is performed.

According to an aspect of the present invention, a shovel that can provide accurate machine guidance even when a consumable part such as an excavating blade is worn is provided.

Figure 1:
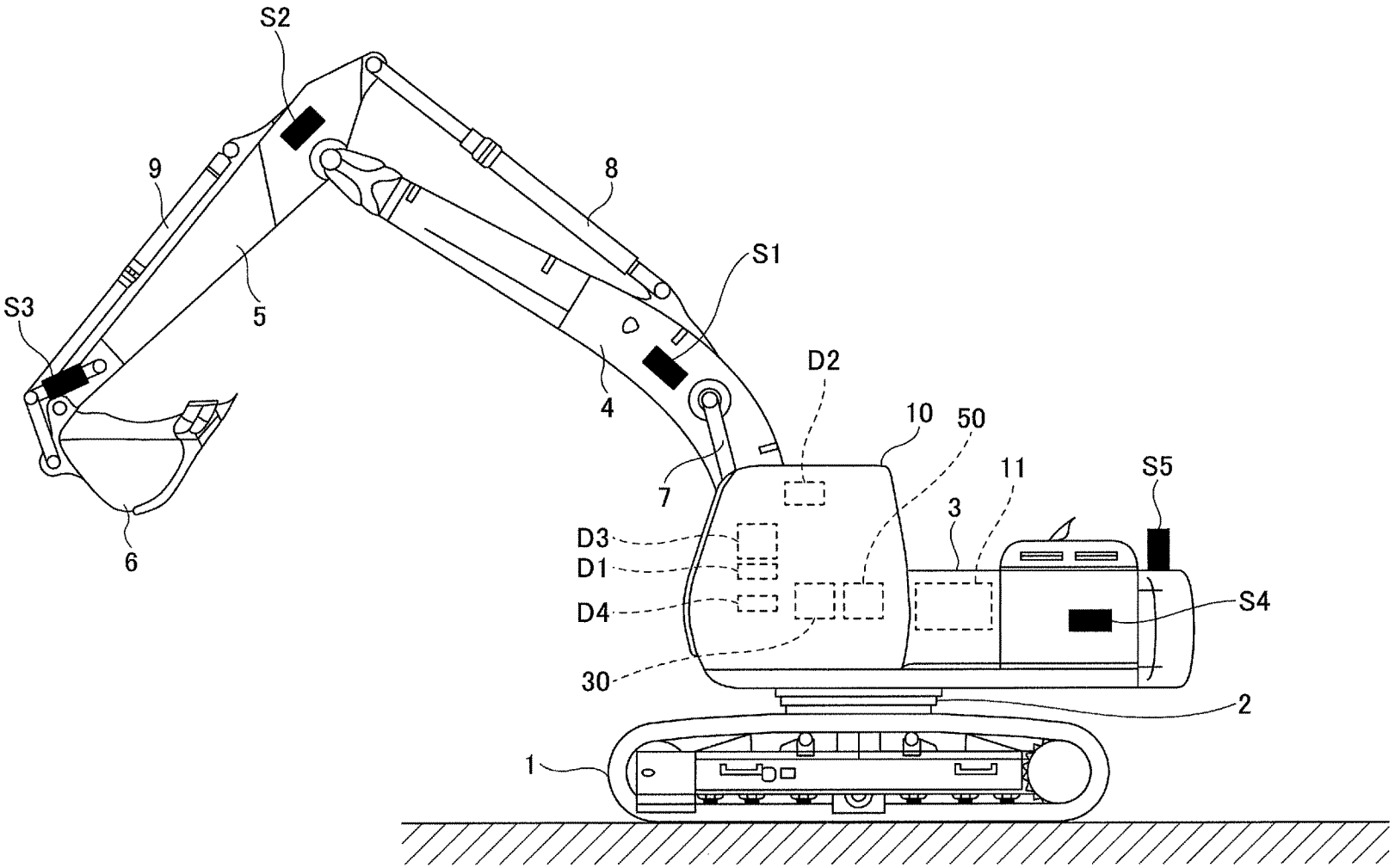
FIG. 1 is a side view of a shovel according to an embodiment of the present invention.

FIG. 1 is a side view of a shovel (excavator) that is an example of a construction machine according to an embodiment of the present invention. An upper-part turning body 3 is turnably mounted on a lower-part traveling body 1 of the shovel through a turning mechanism 2. A boom 4 is attached to the upper-part turning body 3. An arm 5 is attached to the end of the boom 4, and a bucket 6 serving as an end attachment is attached to the end of the arm 5. A breaker may be attached as an end attachment.

The boom 4, the arm 5, and the bucket 6 form an excavating attachment that is an example of an attachment, and are hydraulically driven by a boom cylinder 7, an arm cylinder 8, and a bucket cylinder 9, respectively. A boom angle sensor S1 is attached to the boom 4, an arm angle sensor S2 is attached to the arm 5, and a bucket angle sensor S3 is attached to a bucket link.

The boom angle sensor S1 is a sensor that detects the rotation angle of the boom 4, and according to this embodiment, is an acceleration sensor that detects the inclination angle of the boom 4 relative to a horizontal plane (hereinafter referred to as "boom angle") by detecting gravitational acceleration. Specifically, the boom angle sensor S1 detects the rotation angle of the boom 4 about a boom foot pin that couples the upper-part turning body 3 and the boom 4 as a boom angle.

The arm angle sensor S2 is a sensor that detects the rotation angle of the arm 5, and according to this embodiment, is an acceleration sensor that detects the inclination angle of the aria 5 relative to a horizontal plane (hereinafter referred to as "am angle") by detecting gravitational acceleration. Specifically, the arm angle sensor S2 detects the rotation angle of the arm 5 about an am pin that couples the boom 4 and the arm 5 as an arm angle.

The bucket angle sensor S3 is a sensor that detects the rotation angle of the bucket 6, and according to this embodiment, is an acceleration sensor that detects the inclination angle of the bucket 6 relative to a horizontal plane (hereinafter referred to as "bucket angle") by detecting gravitational acceleration. Specifically, the bucket angle sensor S3 detects the rotation angle of the bucket 6 about a bucket pin that couples the arm 5 and the bucket 6 as a bucket angle.

At least one of the boom angle sensor S1, the arm angle sensor S2, and the bucket angle sensor S3 may be a potentiometer using a variable resistor, a stroke sensor that detects the amount of stroke of a corresponding hydraulic cylinder, a rotary encoder that detects a rotation angle about a pin, or the like. The boom angle sensor S1, the arm angle sensor S2, and the bucket angle sensor S3 serve as posture sensors for calculating the posture of the attachment.

A cabin 10 is provided and power sources such as an engine 11 are mounted on the upper-part turning body 3. Furthermore, a machine body inclination sensor S4 and a positioning sensor S5 are attached to the upper-part turning body 3. An input device D1, an audio output device D2, a display device D3, a storage device D4, a controller 30, and a machine guidance device 50 are mounted in the cabin 10.

The controller 30 is a control device that controls the driving of the shovel. According to this embodiment, the controller 30 is composed of a processor that includes a CPU and an internal memory. The CPU executes programs stored in the internal memory to implement various functions of the controller 30.

The machine guidance device 50 is a device that guides an operator's operation of the shovel. According to this embodiment, the machine guidance device 50 guides an operator's operation of the shovel by, for example, visually and aurally informing the operator of a vertical distance between the surface of a target terrain set by the operator and the leading edge (tooth tip) position of the bucket 6. Alternatively, the machine guidance device 50 may only visually inform the operation of the distance or only aurally inform the operation of the distance. Specifically, like the controller 30, the machine guidance device 50 is composed of a processor that includes a CPU and an internal memory as a controller. The CPU executes programs stored in the internal memory to implement various functions of the machine guidance device 50. The machine guidance device 50 may be integrated into the controller 30.

The machine body inclination sensor S4 is a sensor that detects the inclination angles of the upper-part turning body 3 relative to a horizontal plane, and according to this embodiment, is an acceleration sensor that detects the inclination angle of the front-rear axis of the upper-part turning body 3 relative to a horizontal plane (hereinafter referred to as "machine body pitch angle") and the inclination angle of the right-left axis of the upper-part turning body 3 relative to a horizontal plane (hereinafter referred to as "machine body roll angle") by detecting gravitational acceleration.

The positioning sensor S5 is a device that measures the position and orientation of the shovel. According to this embodiment, the positioning sensor S5 includes a GPS receiver and an electronic compass, and outputs, to the machine guidance device 50, information on the position coordinates (latitude, longitude, and altitude) and the orientation (direction) of the positioning sensor S5 in the World Geodetic System. The World Geodetic System is a three-dimensional orthogonal XYZ coordinate system in which the origin is placed at the center of gravity of the earth, the X axis is taken in the direction of the intersection of the Greenwich meridian and the equator, the Y axis is taken in the direction of 90 degrees east longitude, and the Z axis is taken in the direction of the north pole. The electronic compass is composed of, for example, a three-axis magnetic sensor. The positioning sensor S5 may be a GPS compass composed of two GPS receivers.

The input device D1 is a device for an operator of the shovel to input various kinds of information. According to this embodiment, the input device D1 is hardware switches attached to the periphery of the display screen of the display device D3. An operator of the shovel inputs various kinds of information to the machine guidance device 50 through the input device D1. The input device D1 may alternatively be a touchscreen. As yet another alternative, the input device D1 may be a USB memory. In this case, the operator can input information stored in the USB memory to the machine guidance device 50 by inserting the USB memory into a USB connector installed in the cabin 10.

The audio output device D2 is a device that outputs various kinds of audio information in response to audio output instructions from the machine guidance device 50. According to this embodiment, an in-vehicle loudspeaker directly connected to the machine guidance device 50 is used. A buzzer may alternatively be used.

The display device D3 is a device that outputs various kinds of image information in response to instructions from the machine guidance device 50. According to this embodiment, an in-vehicle liquid crystal display directly connected to the machine guidance device 50 is used.

The storage device D4 is a device for storing various kinds of information. According to this embodiment, the storage device D4 is a non-volatile storage medium such as a semiconductor memory, and stores various kinds of information output by the machine guidance device 50, etc.

Figure 2:
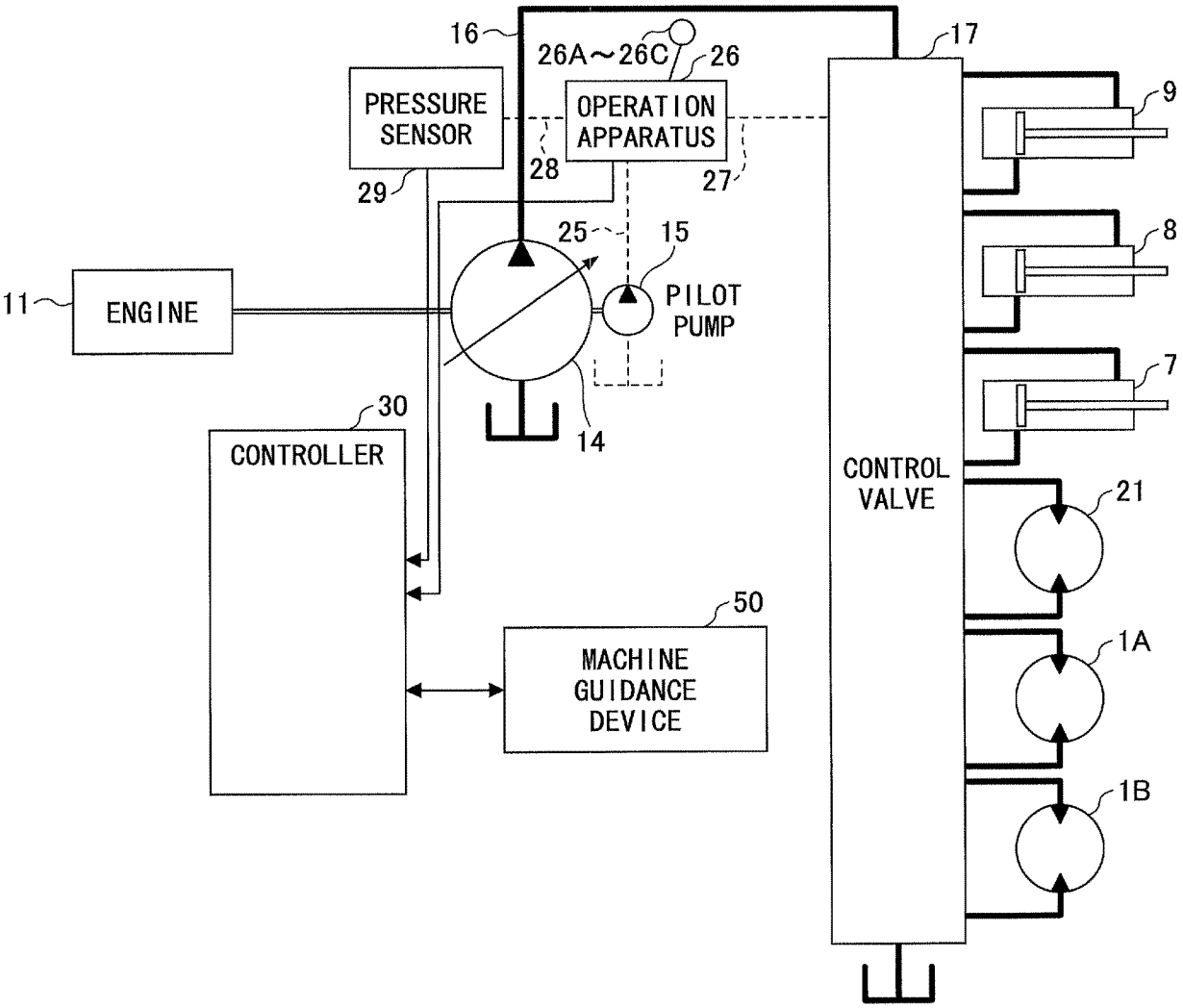
FIG. 2 is a block diagram illustrating an arrangement of the drive system of the shovel of FIG. 1.

FIG. 2 is a block diagram illustrating an arrangement of the drive system of the shovel of FIG. 1. In FIG. 2, a mechanical power system, a high-pressure hydraulic line, a pilot line, and an electric drive and control system are indicated by a double line, a thick solid line, a dashed line, and a thin solid line, respectively.

The engine 11 is a drive source of the shovel. According to this embodiment, the engine 11 is a diesel engine that adopts isochronous control that maintains the rotation speed of an engine irrespective of an increase or decrease in a load on the engine.

A main pump 14 and a pilot pump 15 serving as hydraulic pumps are connected to the engine 11. A control valve 17 is connected to the main pump 14 via a high-pressure hydraulic line 16.

The control valve 17 is a hydraulic control device that controls the hydraulic system of the shovel. Hydraulic actuators such as a right-side traveling hydraulic motor 1A, a left-side traveling hydraulic motor 1B, the boom cylinder 7, the arm cylinder 8, the bucket cylinder 9, and a turning hydraulic motor 21 are connected to the control valve 17 through high-pressure hydraulic lines.

An operation apparatus 26 is connected to the pilot pump 15 through a pilot line 25. The operation apparatus 26 is an apparatus for operating hydraulic actuators, and includes a lever 26A, a lever 26B, and a pedal 26C. According to this embodiment, the operation apparatus 26 is connected to the control valve 17 through a hydraulic line 27. Furthermore, the operation apparatus 26 is connected to a pressure sensor 29 through a hydraulic line 28. The pressure sensor 29 is a sensor that detects the contents of an operation of the operation apparatus 26 in the form of pressure, and outputs a detected value to the controller 30.

Figure 3:
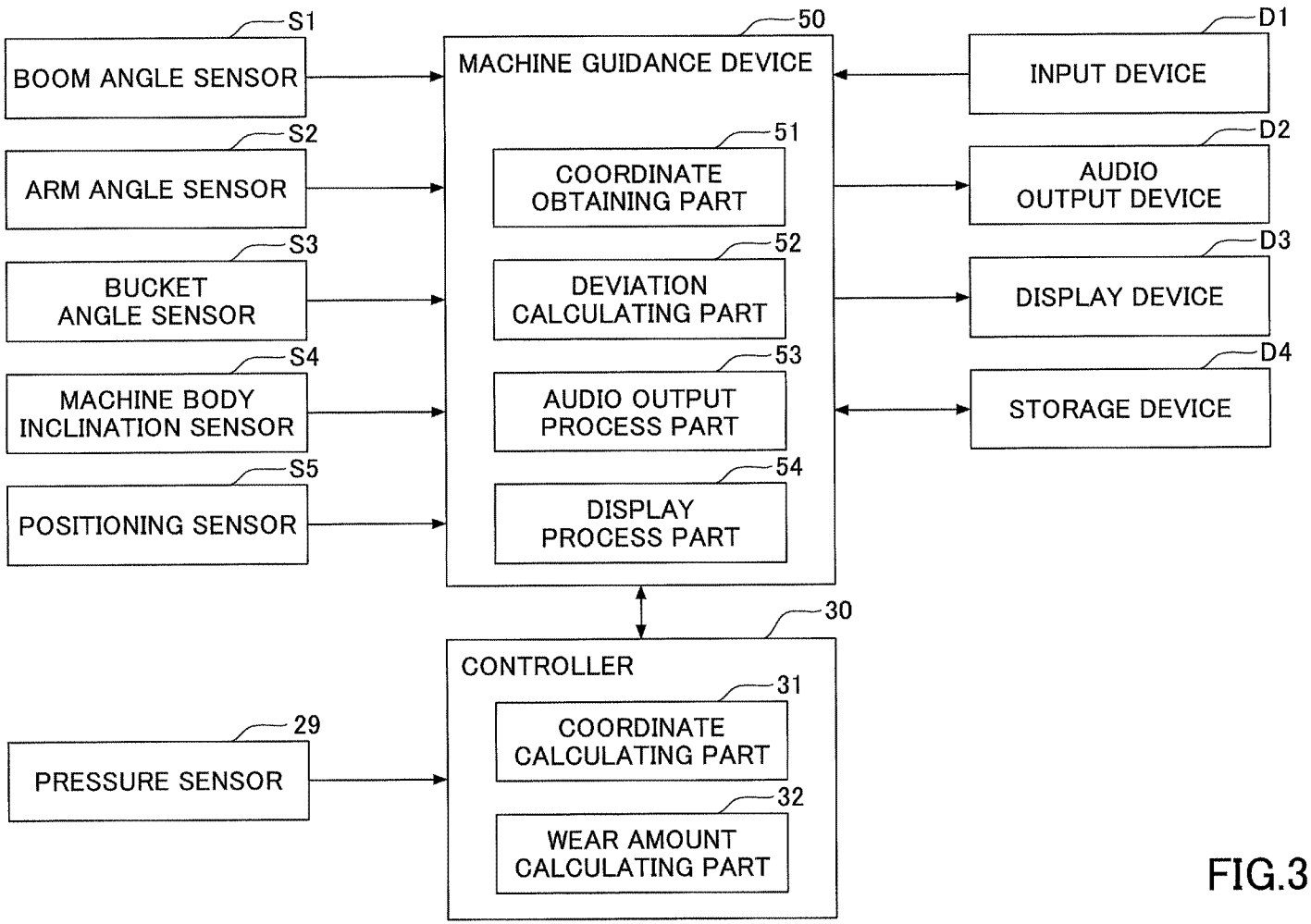
FIG. 3 is a functional block diagram illustrating an arrangement of a controller and a machine guidance device.

Next, various functional elements of the controller 30 and the machine guidance device 50 are described with reference to FIG. 3. FIG. 3 is a functional block diagram illustrating an arrangement of the controller 30 and the machine guidance device 50.

According to this embodiment, the machine guidance device 50 receives the outputs of the boom angle sensor S1, the arm angle sensor S2, the bucket angle sensor S3, the machine body inclination sensor S4, the positioning sensor S5, the input device D1, and the controller 30 to output various instructions to each of the audio output device D2, the display device D3, and the storage device D4. Furthermore, the machine guidance device 50 includes a coordinate obtaining part 51, a deviation calculating part 52, an audio output process part 53, and a display process part 54. The controller 30 and the machine guidance device 50 are interconnected via a CAN (Controller Area Network).

The coordinate obtaining part 51 is a functional element that obtains the coordinates of a predetermined part of the attachment. According to this embodiment, the coordinate obtaining part 51 derives the origin coordinates (latitude, longitude, and altitude) of a reference coordinate system based on the detection values of the machine body inclination sensor S4 and the positioning sensor S5. The reference coordinate system is a coordinate system based on the shovel and is, for example, a three-dimensional coordinate system in which the extending direction of the excavating attachment is the X axis and the turning axis of the shovel is the Z axis. The positional relationship between the origin coordinates of the reference coordinate system and the coordinates of the attachment position of the positioning sensor S5 (hereinafter referred to as "positioning sensor coordinates") is relatively constant. Therefore, the coordinate obtaining part 51 can uniquely derive the origin coordinates of the reference coordinate system in the World Geodetic System from the detection values of the machine body inclination sensor S4 and the positioning sensor S5.

Specifically, the coordinate obtaining part 51 derives the origin coordinates of the reference coordinate system in the World Geodetic System based on the position coordinates and the direction of the positioning sensor S5 in the World Geodetic System, which are the detection values of the positioning sensor S5.

Furthermore, the coordinate obtaining part 51 derives a rotation matrix for rotating the reference coordinate system to match the three axes of the reference coordinate system to the three axes of the World Geodetic System, based on the machine body roll angle and the machine body pitch angle, which are the detection values of the machine body inclination sensor S4.

As a result, once the coordinates of a point in the reference coordinate system is determined, the coordinate obtaining part 51 can derive coordinates in the World Geodetic System with respect to the point based on the origin coordinates of the reference coordinate system in the World Geodetic System and the rotation matrix.

Furthermore, the coordinate obtaining part 51 derives the posture of the excavating attachment based on the detection values of the boom angle sensor S1, the arm angle sensor S2, and the bucket angle sensor S3, in order to make it possible to derive coordinates in the reference coordinate system corresponding to each point on the excavating attachment and further to make it possible to derive coordinates in the World Geodetic System with respect to each point. Points on the excavating attachment include the position of the bucket pin and the leading edge position of the bucket 6.

The deviation calculating part 52 derives a deviation between the current position and the target position of the leading edge of the bucket 6. According to this embodiment, the deviation calculating part 52 derives a deviation between the current position and the target position of the leading edge of the bucket 6 based on the coordinates of the leading edge position of the bucket 6 obtained by the coordinate obtaining part 51 and target terrain information. The target terrain information is information on a terrain at the completion of work, and includes a group of coordinates representing a target terrain. Furthermore, the target terrain information is input through the input device D1 and stored in the storage device D4.

For example, the deviation calculating part 52 derives a vertical distance between the leading edge position of the bucket 6 and the surface of the target terrain as the deviation. The deviation may alternatively be a horizontal distance between the leading edge position of the bucket 6 and the surface of the target terrain, the shortest distance, or the like.

The audio output process part 53 controls the contents of audio information output from the audio output device D2. According to this embodiment, the audio output process part 53 causes an intermittent sound to be output from the audio output device D2 as a guidance sound when the deviation derived by the deviation calculating part 52 is at or below a predetermined value. Furthermore, the audio output process part 53 reduces the output interval (the length of a silent part of) the intermittent sound as the deviation decreases. When the deviation is zero, that is, when the leading edge position of the bucket 6 and the surface of the target terrain match, the audio output process part 53 may cause a continuous sound (an intermittent sound of no output interval) to be output from the audio output device D2. Furthermore, when the positive or negative of the deviation is inverted, the audio output process part 53 may change the pitch (frequency) of the intermittent sound. The deviation is a positive value when, for example, the leading edge position of the bucket 6 is vertically above the surface of the target terrain.

The display process part 54 controls the contents of various kinds of image information to be displayed on the display device D3. According to this embodiment, the display process part 54 causes the relationship between the coordinates of the leading edge position of the bucket 6 obtained by the coordinate obtaining part 51 and a group of coordinates representing a target terrain to be displayed on the display device D3. Specifically, the display process part 54 causes a CG image of the bucket 6 and a cross section of the target terrain viewed from the side (the Y axis direction) and a CG image of the bucket 6 and a cross section of the target terrain viewed from the rear (the X axis direction) to be displayed on the display device D3. The display process part 54 may display the size of the deviation derived by the deviation calculating part 52 in a bar graph.

Figure 4A:
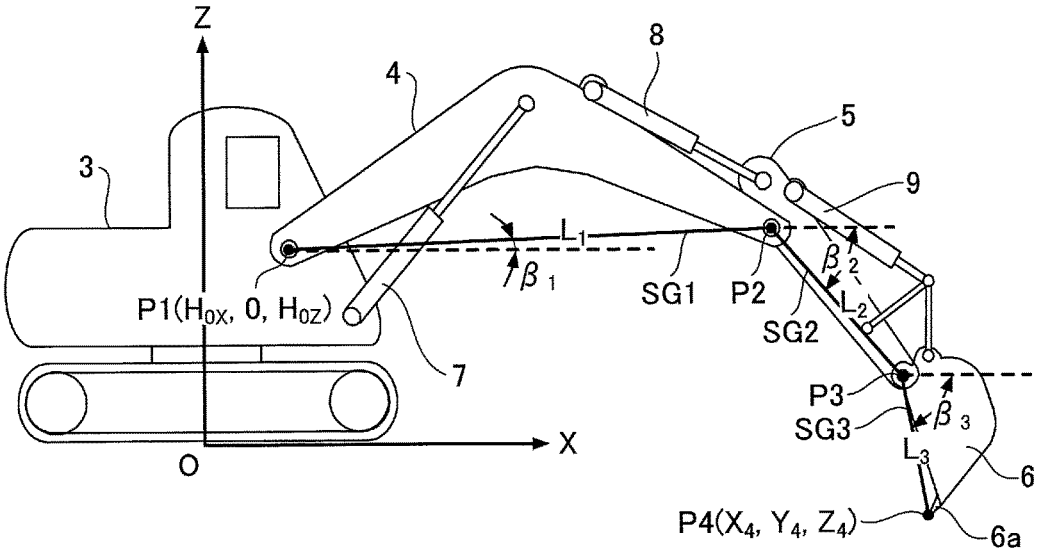
FIG. 4A is a side view of the shovel, illustrating a reference coordinate system.

Next, the reference coordinate system, which is a three-dimensional orthogonal coordinate system, is described with reference to FIG. 4A and FIG. 4B. FIG. 4A is a side view of the shovel, and FIG. 4B is a plan view of the shovel.

Figure 4B:
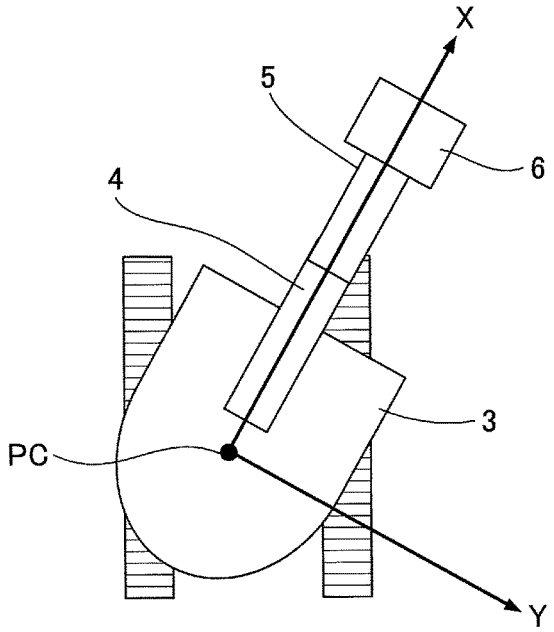
FIG. 4B is a plan view of the shovel, illustrating the reference coordinate system.

As illustrated in FIG. 4A and FIG. 4B, the Z axis of the reference coordinate system corresponds to a turning axis PC of the shovel, and the origin O of the reference coordinate system corresponds to the intersection of the turning axis PC and the ground contact plane of the shovel.

The X axis orthogonal to the Z axis extends in the extending direction of the excavating attachment, and the Y axis also orthogonal to the Z axis extends in a direction perpendicular to the extending direction of the excavating attachment. That is, the X axis and the Y axis rotate about the Z axis as the shovel turns.

Furthermore, as illustrated in FIG. 4A, the position of attachment of the boom 4 to the upper-part turning body 3 is represented by a boom foot pin position P1 that is the position of the boom foot pin serving as a boom rotation axis. Likewise, the position of attachment of the arm 5 to the boom 4 is represented by an arm pin position P2 that is the position of the arm pin serving as an arm rotation axis. The position of attachment of the bucket 6 to the arm 5 is represented by a bucket pin position P3 that is the position of the bucket pin serving as a bucket rotation axis. The tip position of a tooth 6*a* of the bucket 6 is represented by a bucket leading edge position P4.

The length of a line segment SG1 connecting the boom foot pin position P1 and the arm pin position P2 is represented by a predetermined value $L_1$ as a boom length. The length of a line segment SG2 connecting the arm pin position P2 and the bucket pin position P3 is represented by a predetermined value $L_2$ as an arm length. The length of a line segment SG3 connecting the bucket pin position P3 and the bucket leading edge position P4 is represented by a predetermined value $L_3$ as a bucket length. The predetermined values $L_1$, $L_2$, and $L_3$ are pre-stored in the storage device D4 or the like.

Furthermore, the boom angle formed between the line segment SG1 and a horizontal plane is represented by $\beta_1$. The arm angle formed between the line segment SG2 and a horizontal plane is represented by $\beta_2$. The bucket angle formed between the line segment SG3 and a horizontal plane is represented by $\beta_3$. In FIG. 4A, with respect to the boom angle $\beta_1$, the arm angle $\beta_2$, and the bucket angle $\beta_3$, a counterclockwise direction regarding a line parallel to the X axis is determined as a positive direction.

Here, letting the three-dimensional coordinates (X, Y, Z) of the boom foot pin position P1 be $(H_{0x}, 0, H_{0z})$ and letting the three-dimensional coordinates (X, Y, Z) of the bucket leading edge position P4 be $(X_4, Y_4, Z_4)$, $X_4$ and $Z_4$ are represented by Eq. (1) and Eq. (2), respectively.

$$X_4=H_{0X}+L_1 \cos \beta_1+L_2 \cos \beta_2+L_3 \cos \beta_3 \quad (1)$$

$$Z_4=H_{0Z}+L_1 \sin \beta_1+L_2 \sin \beta_2+L_3 \sin \beta_3 \quad (2)$$

$Y_4$ is 0 because the bucket leading edge position P4 is in the XZ plane. Furthermore, because the boom foot pin position P1 is constant relative to the origin O, the coordinates of the arm pin position P2 are uniquely determined once the boom angle $\beta_1$ is determined. Likewise, the coordinates of the bucket pin position P3 are uniquely determined once the boom angle $\beta_1$ and the arm angle $\beta_2$ are determined, and the coordinates of the bucket leading edge position P4 are uniquely determined once the boom angle $\beta_1$, the arm angle $\beta_2$, and the bucket angle $\beta_3$ are determined.

Furthermore, the coordinate obtaining part 51 can uniquely derive the coordinates of the points P1 through P4 in the World Geodetic System once the coordinates of the points P1 through P4 in the reference coordinate system are determined.

The tooth 6*a* of the bucket 6, however, is a consumable part worn by use. Therefore, the three-dimensional coordinates (X, Y, Z) of the bucket leading edge position P4 calculated using Eq. (1) and Eq. (2) noted above, (Xe, Ye, Ze), deviate from the three-dimensional coordinates of the actual bucket leading edge position as wear of the tooth 6*a* progresses. As a result, the coordinate obtaining part 51 are prevented from obtaining accurate coordinates of the bucket leading edge position P4, thus preventing the machine guidance device 50 from accurately guiding an operation of the shovel.

Therefore, according to this embodiment, the controller 30 executes the below-described tip information deriving process to derive accurate coordinates of the bucket leading edge position P4 to make it possible to accurately guide an operation of the shovel even when the tooth 6*a* is worn.

Specifically, the controller 30 includes a coordinate calculating part 31 and a wear amount calculating part 32 as functional elements.

The coordinate calculating part 31 is a functional element that calculates the coordinates of the leading edge of a consumable part. According to this embodiment, the coordinate calculating part 31 derives the coordinates of the bucket leading edge position P4 in the World Geodetic System based on the coordinates of the bucket pin position P3 obtained by the coordinate obtaining part 51 and the bucket angle detected by the bucket angle sensor S3 when the tooth 6*a* is caused to contact known coordinates in the World Geodetic System.

The wear amount calculating part 32 is a functional element that calculates the amount of wear of a consumable part. According to this embodiment, the wear amount calculating part 32 calculates the amount of wear of the tooth 6*a* based on the coordinates of the bucket leading edge position P4 calculated by the coordinate calculating part 31 before the tooth 6*a* is worn and on the coordinates of the bucket leading edge position P4 calculated by the coordinate calculating part 31 after the tooth 6*a* is worn. The consumable part may be the rod of a breaker.

Figure 5:
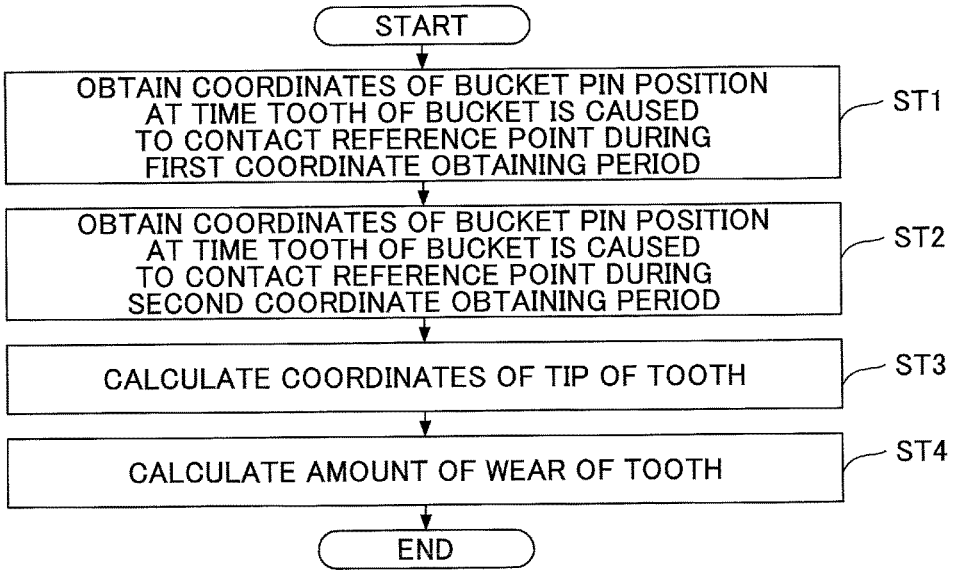
FIG. 5 is a flowchart illustrating a flow of a tip information deriving process.
Figure 6A:
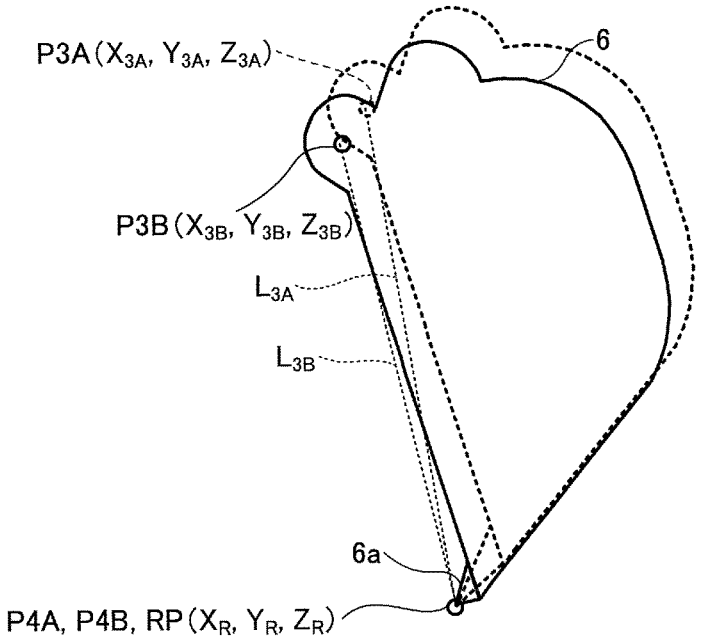
FIG. 6A is a side view of a bucket, illustrating coordinates with respect to the tip information deriving process of FIG. 5.
Figure 6B:
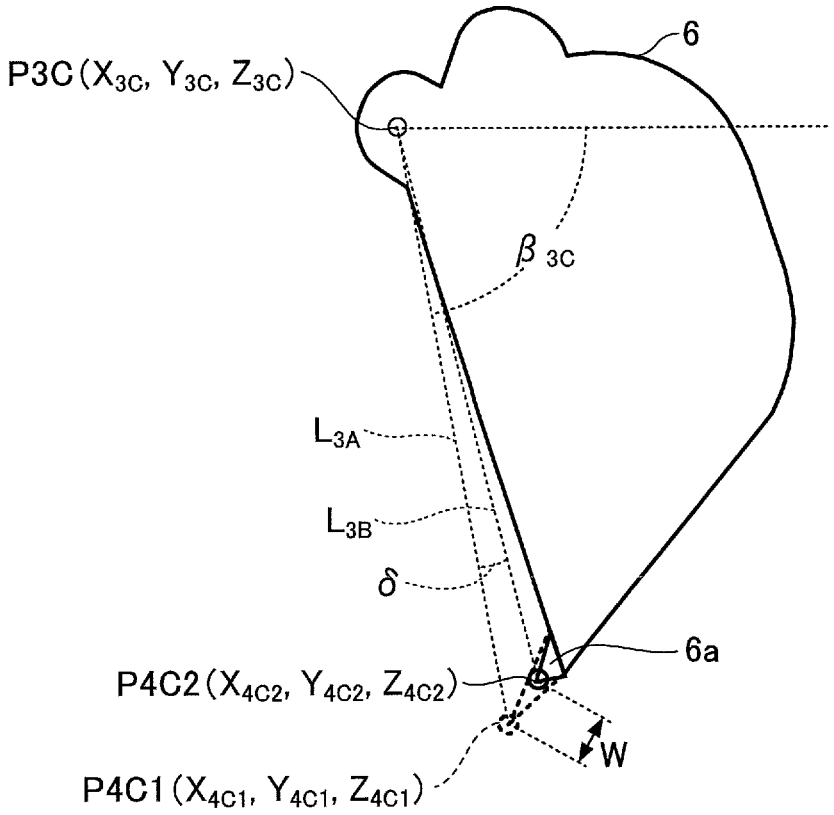
FIG. 6B is a side view of the bucket, illustrating coordinates with respect to the tip information deriving process of FIG. 5.

Here, a process of deriving information on the tip of the tooth 6*a* by the controller 30 (hereinafter referred to as "tip information deriving process") is described with reference to FIG. 5, FIG. 6A, and FIG. 6B. FIG. 5 is a flowchart illustrating a flow of a tip information deriving process. FIG. 6A and FIG. 6B are side views of the bucket 6, illustrating coordinates with respect to the tip information deriving process of FIG. 5. Furthermore, FIG. 6A depicts the case where the tip of the tooth 6*a* is caused to contact a reference point RP, where a thick solid line indicates the bucket 6 with the tip of the tooth 6*a* being worn and a thick dotted line indicates the bucket 6 with the tip of the tooth 6*a* being unworn. Furthermore, FIG. 6B shows a state where the two images of the bucket 6 of FIG. 6A are superimposed except for the tooth 6*a*.

The reference point is a feature having coordinates of a predetermined geodetic system and includes a survey marker such as a reference pile. According to this embodiment, the reference point has coordinates of the World Geodetic System. The coordinates $(X_R, Y_R, Z_R)$ of the reference point PR are known to the controller 30 and the machine guidance device 50.

First, the coordinate calculating part 31 obtains the coordinates $(X_{3A}, Y_{3A}, Z_{3A})$ of a bucket pin position P3A that the coordinate obtaining part 51 obtains when the tip of the tooth 6*a* is caused to contact the reference point RP, during a first coordinate obtaining period (step ST1). A coordinate obtaining period means a period during which the coordinate obtaining part 51 obtains coordinates under the same wear condition. According to this embodiment, the first coordinate obtaining period is a period during which the coordinate obtaining part 51 can obtain coordinates while the tooth 6*a* of the bucket 6 is new without wear, and includes a period immediately after the initial setting of the shovel and a period immediately after replacement of the tooth 6*a*.

Specifically, an operator of the shovel operates the operation apparatus 26 including a boom operation lever, an arm operation lever, a bucket operation lever, a turning operation lever, and a traveling pedal to cause the tooth 6*a* of the bucket 6 to contact the reference point RP. Then, the operator instructs the machine guidance device 50 through the input device D1 to store the coordinates of the bucket pin position P3A at the time. In response to the instruction, the coordinate obtaining part 51 of the machine guidance device 50 stores the coordinates of the bucket pin position P3A in the storage device D4.

The operator may instruct the machine guidance device 50 to cause the tooth 6*a* of the bucket 6 to contact the reference point RP multiple times while changing the posture of the excavating attachment and store the coordinates of the bucket pin position P3A every time the contact is made. In this case, the coordinate obtaining part 51 may determine the average coordinates of the multiple sets of coordinates stored multiple times as the coordinates of the bucket pin position P3A.

Thereafter, the coordinate calculating part 31 obtains the coordinates ($X_{3B}$, $Y_{3B}$, $Z_{3B}$) of a bucket pin position P3B that the coordinate obtaining part 51 obtains when the tip of the tooth 6*a* is caused to contact the reference point RP, during a second coordinate obtaining period (step ST2). According to this embodiment, the second coordinate obtaining period is a coordinate obtaining period after the new tooth 6*a* is actually used, namely, a coordinate obtaining period after the tooth 6*a* is worn, such as a coordinate obtaining period after the shovel is operated for a predetermined shovel operating time after the start of use of the new tooth 6*a*. The second coordinate obtaining period may alternatively be a period after passage of a predetermined number of days since the start of use of the new tooth 6*a*.

Specifically, the operator of the shovel obtains the coordinates of the bucket pin position P3B during the second coordinate obtaining period in the same manner as in the obtaining of the coordinates of the bucket pin position P3A during the first coordinate obtaining period.

Thereafter, the coordinate calculating part 31 calculates the coordinates of the tip of the tooth 6*a* (step ST3). According to this embodiment, the coordinate calculating part 31 calculates a distance between the bucket pin position P3A at the time the tooth 6*a* is new without wear and the reference point RP (a bucket leading edge position P4A) (hereinafter referred to as "tip distance"), $L_{3A}$, using Eq. (3) below. Specifically, the coordinate calculating part 31 calculates the tip distance $L_{3A}$ based on the coordinates ($X_{3A}$, $Y_{3A}$, $Z_{3A}$) of the bucket pin position P3A obtained by the coordinate obtaining part 51 during the first coordinate obtaining period and the coordinates ($X_R$, $Y_R$, $Z_R$) of the reference point PR.

$$L_{3A}=\sqrt{(X_R-X_{3A})^2+(Z_R-Z_{3A})^2} \tag{3}$$

In addition, the coordinate calculating part 31 calculates a tip distance $L_{3B}$ between the bucket pin position P3B after wear of the tooth 6*a* and the reference point RP (a bucket leading edge position P4B), using Eq. (4) below. Specifically, the coordinate calculating part 31 calculates the tip distance $L_{3B}$ based on the coordinates ($X_{3B}$, $Y_{3B}$, $Z_{3B}$) of the bucket pin position P3B obtained by the coordinate obtaining part 51 during the second coordinate obtaining period and the coordinates ($X_R$, $Y_R$, $Z_R$) of the reference point PR. The coordinate values $Y_{3A}$, $Y_{3B}$, and $Y_R$ are the same value (for example, zero).

$$L_{3B}=\sqrt{(X_R-X_{3B})^2+(Z_R-Z_{3B})^2} \tag{4}$$

Thereafter, the coordinate calculating part 31 calculates the coordinates ($X_{4C1}$, $Y_{4C1}$, $Z_{4C1}$) of a bucket leading edge position P4C1 at the time the tooth 6*a* is new without wear based on the relationship illustrated in FIG. 6B. According to this embodiment, the coordinate calculating part 31 calculates the coordinates ($X_{4C1}$, $Y_{4C1}$, $Z_{4C1}$) of the bucket leading edge position P4C1 using Eq. (5) and Eq. (6) below. Specifically, the coordinate calculating part 31 calculates the coordinates ($X_{4C1}$, $Y_{4C1}$, $Z_{4C1}$) based on the coordinates ($X_{3C}$, $Y_{3C}$, $Z_{3C}$) of a bucket pin position P3C obtained by the coordinate obtaining part 51 and a bucket angle $\beta_{3C}$ detected by the bucket angle sensor S3 when the excavating attachment is in any posture, and on the tip distance $L_{3A}$. The coordinate values $Y_{3C}$ and $Y_{4C1}$ are the same value (for example, zero).

$$X_{4C1}=X_{3C}+L_{3A}\cos\beta_{3C} \tag{5}$$

$$Z_{4C1}=Z_{3C}+L_{3A}\sin\beta_{3C} \tag{6}$$

Furthermore, the coordinate calculating part 31 calculates the coordinates ($X_{4C2}$, $Y_{4C2}$, $Z_{4C2}$) of a bucket leading edge position P4C2 after wear of the tooth 6*a* using Eq. (7) and Eq. (8) below. Specifically, the coordinate calculating part 31 calculates the coordinates ($X_{4C2}$, $Y_{4C2}$, $Z_{4C2}$) based on the coordinates ($X_{3C}$, $Y_{3C}$, $Z_{3C}$) of the bucket pin position P3C obtained by the coordinate obtaining part 51 and the bucket angle $\beta_{3C}$ detected by the bucket angle sensor S3 when the excavating attachment is in any posture, and on the tip distance $L_{3B}$. The coordinate values $Y_{3C}$ and $Y_{4C2}$ are the same value (for example, zero). An angle $\delta$ is an angle foiled between a line segment P3C-P4C1 and a line segment P3C-P4C2, and is an angle uniquely determined once the tip distance $L_{3A}$ and the tip distance $L_{3B}$ are determined.

$$X_{4C2}=X_{3C}+L_{3B}\cos(\beta_{3C}-\delta) \tag{7}$$

$$Z_{4C2}=Z_{3C}+L_{3B}\sin(\beta_{3C}-\delta) \tag{8}$$

Thereafter, the wear amount calculating part 32 calculates the amount of wear of the tooth 6*a* (step St4). According to this embodiment, the wear amount calculating part 32 calculates an amount of wear W of the tooth 6*a* of the bucket 6, using Eq. (9) below. Specifically, the wear amount calculating part 32 calculates the amount of wear W based on the coordinates ($X_{4C1}$, $Y_{4C1}$, $Z_{4C1}$) of the bucket leading edge position P4C1 at the time the tooth 6*a* is new without wear and the coordinates ($X_{4C2}$, $Y_{4C2}$, $Z_{4C2}$) of the bucket leading edge position P4C2 after wear of the tooth 6*a*, calculated by the coordinate calculating part 31.

$$W=\sqrt{(X_{4C2}-X_{4C1})^2+(Z_{4C2}-Z_{4C1})^2} \tag{9}$$

According to this configuration, the controller 30 derives a tip distance based on the coordinates of the bucket pin position P3 that the coordinate obtaining part 51 obtains when the tooth 6*a* is caused to contact the reference point RP that is known coordinates. Furthermore, the controller 30 derives the coordinates of the bucket leading edge position P4 based on the tip distance and the bucket angle detected by the bucket angle sensor S3. Therefore, after execution of the tip information deriving process, the controller 30 can accurately derive the coordinates of the bucket leading edge position P4 by obtaining the coordinates of the bucket pin position P3 irrespective of whether the tooth 6*a* is worn or not.

Furthermore, the controller 30 can calculate the amount of wear W using the tip distances derived during the two coordinate obtaining periods. In this case, instead of directly deriving the coordinates of the bucket leading edge position P4 corresponding to the tip of the worn tooth 6*a*, the controller 30 may indirectly derive the coordinates of the bucket leading edge position P4 corresponding to the tip of the worn tooth 6*a*. Specifically, the controller 30 may derive the coordinates of the bucket leading edge position P4 corresponding to the tip of the worn tooth 6*a* by deriving the coordinates of the bucket leading edge position P4 corresponding to the tip of the unworn tooth 6*a* and thereafter correcting the coordinates of the bucket leading edge position P4 based on the amount of wear W.

The machine guidance device 50 can provide machine guidance using the coordinates of the bucket leading edge position P4 in which wear is taken into account, derived by the controller 30.

Figure 7:
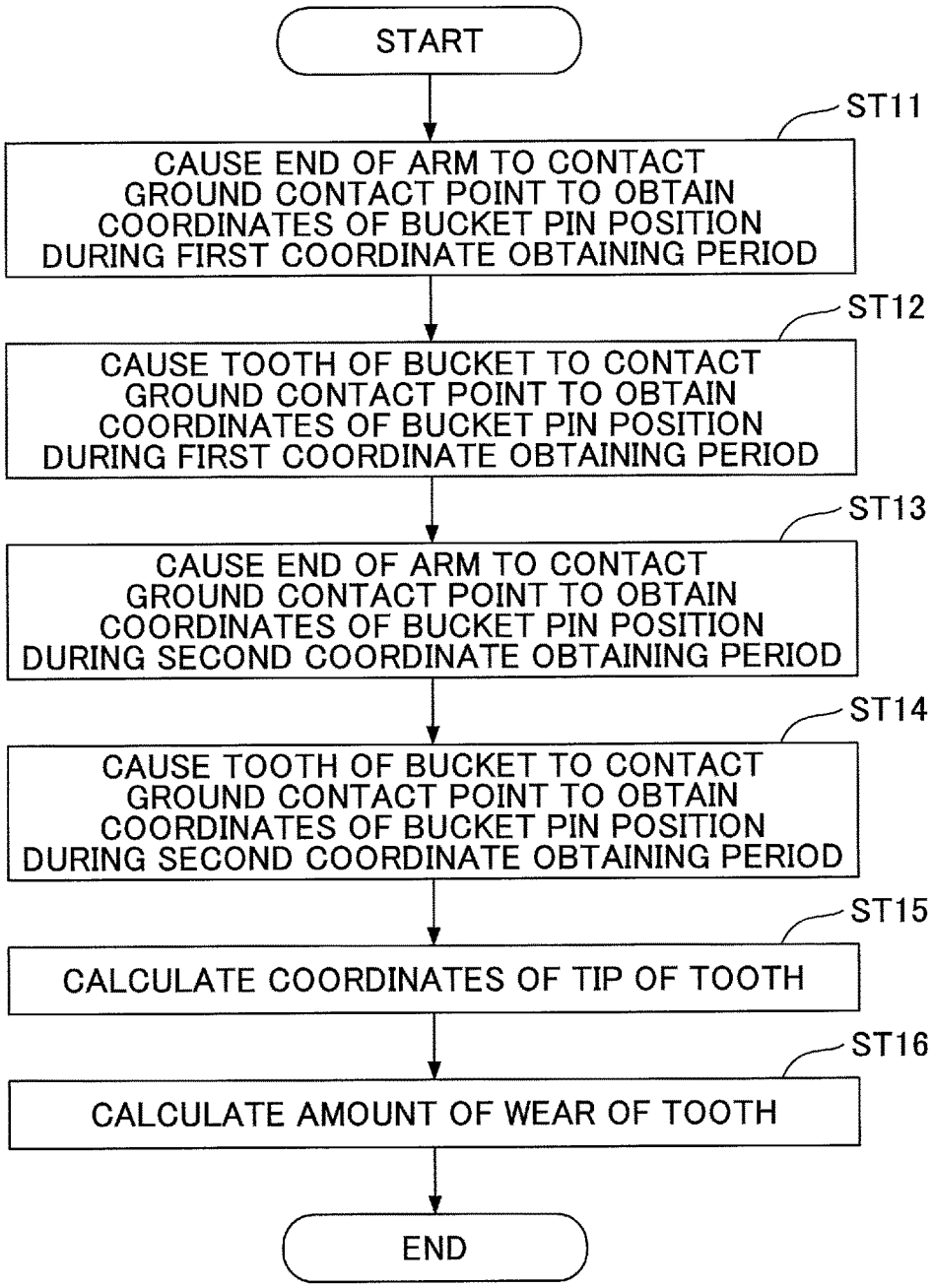
FIG. 7 is a flowchart illustrating a flow of another tip information deriving process.
Figure 8A:
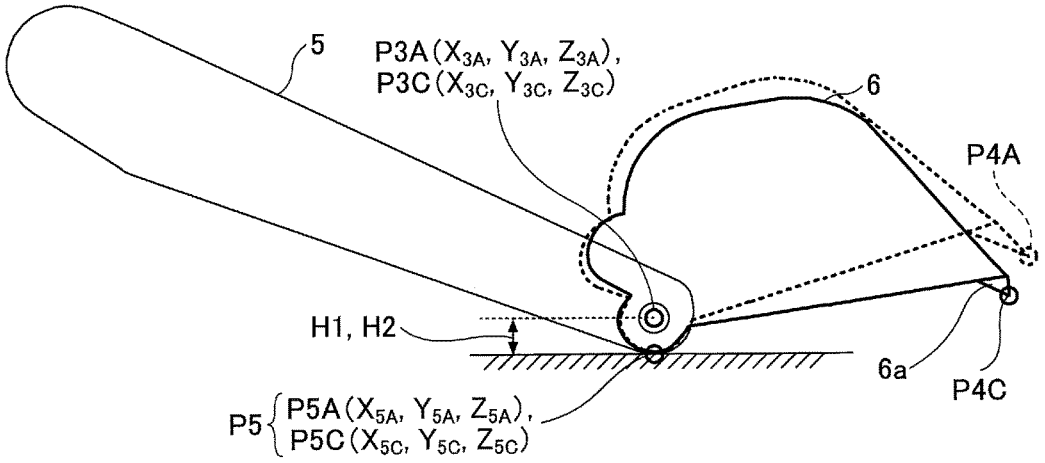
FIG. 8A is a side view of an excavating attachment, illustrating coordinates with respect to the tip information deriving process of FIG. 7.
Figure 8B:
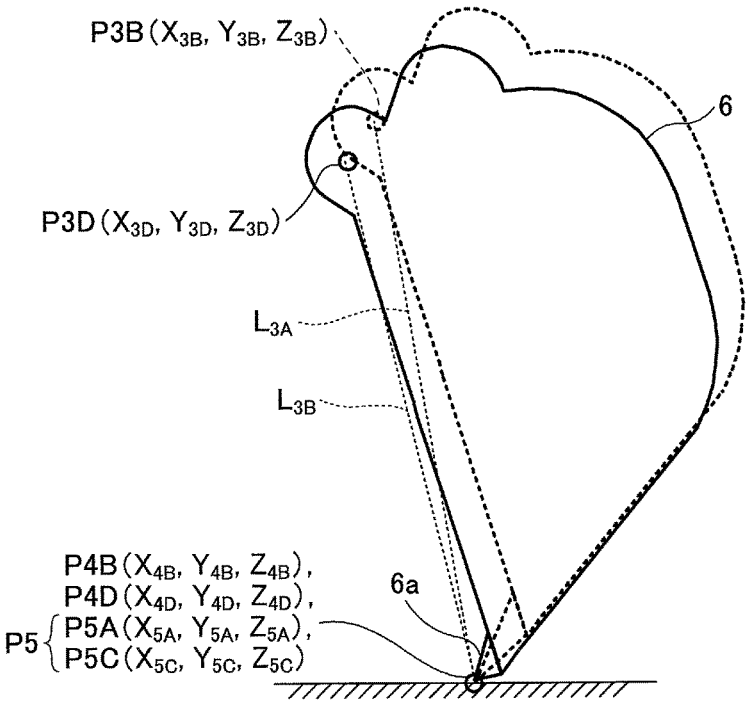
FIG. 8B is a side view of the bucket, illustrating coordinates with respect to the tip information deriving process of FIG. 7.

Next, another tip information deriving process is described with reference to FIG. 7, FIG. 8A, and FIG. 8B. FIG. 7 is a flowchart illustrating a flow of another tip information deriving process. FIG. 8A and FIG. 8B are side views of the excavating attachment, illustrating coordinates with respect to the tip information deriving process of FIG. 7. Furthermore, FIG. 8A depicts the case where the end of the arm 5 is caused to contact a ground contact point P5 (P5A, P5C) that is a point on the ground. FIG. 8B depicts the case where the tooth 6*a* of the bucket 6 is caused to contact the ground contact point P5 (P5A, P5C). A thick solid line indicates the bucket 6 with the tip of the tooth 6*a* being worn, and a thick dotted line indicates the bucket 6 with the tip of the tooth 6*a* being unworn.

The coordinates of the ground contact point P5 (P5A, P5C) are specified as the coordinates of a point on a surface of the arm 5 serving as a non-consumable part at the time the point is caused to contact the ground, and are used in place of the coordinates of a reference point. A point on a surface of a non-consumable part has a constant relative positional relationship with the bucket pin position P3, and the relative positional relationship is known to the controller 30 and the machine guidance device 50.

First, the coordinate calculating part 31 obtains the coordinates ($X_{3A}$, $Y_{3A}$, $Z_{3A}$) of a bucket pin position P3A that the coordinate obtaining part 51 obtains when the end of the arm 5 is caused to contact the ground contact point P5A, during the first coordinate obtaining period (step ST11). According to this embodiment, the first coordinate obtaining period is a period during which the coordinate obtaining part 51 can obtain coordinates while the tooth 6*a* of the bucket 6 is new without wear.

Specifically, an operator of the shovel operates the operation apparatus 26 to cause the end of the arm 5 to contact the ground contact point P5A. Then, the operator instructs the machine guidance device 50 through the input device D1 to store the coordinates of the bucket pin position P3A at the time. In response to the instruction, the coordinate obtaining part 51 of the machine guidance device 50 stores the coordinates of the bucket pin position P3A in the storage device D4.

Thereafter, the coordinate calculating part 31 obtains the coordinates ($X_{3B}$, $Y_{3B}$, $Z_{3B}$) of a bucket pin position P3B that the coordinate obtaining part 51 obtains when the tip of the tooth 6*a* is caused to contact the ground contact point P5A, during the first coordinate obtaining period (step ST12).

Specifically, the operator of the shovel operates the operation apparatus 26 to cause the tip of the tooth 6*a* to contact the ground contact point P5A. For example, the operator causes the tip of the tooth 6*a* to contact the ground contact point P5A so that the extending direction of the tooth 6*a* is perpendicular to the ground (a horizontal plane). Then, the operator instructs the machine guidance device 50 through the input device D1 to store the coordinates of the bucket pin position P3B at the time. In response to the instruction, the coordinate obtaining part 51 of the machine guidance device 50 stores the coordinates of the bucket pin position P3B in the storage device D4.

Thereafter, the coordinate calculating part 31 obtains the coordinates ($X_{3C}$, $Y_{3C}$, $Z_{3C}$) of a bucket pin position P3C that the coordinate obtaining part 51 obtains when the end of the arm 5 is caused to contact the ground contact point P5C, during the second coordinate obtaining period (step ST13). According to this embodiment, the second coordinate obtaining period is a coordinate obtaining period after the new tooth 6*a* is actually used, namely, a coordinate obtaining period after the tooth 6*a* is worn.

Thereafter, the coordinate calculating part 31 obtains the coordinates ($X_{3D}$, $Y_{3D}$, $Z_{3D}$) of a bucket pin position P3D that the coordinate obtaining part 51 obtains when the tip of the tooth 6*a* is caused to contact the ground contact point P5C, during the second coordinate obtaining period (step ST14).

Thereafter, the coordinate calculating part 31 calculates the coordinates of the tip of the tooth 6*a* (step ST15). According to this embodiment, the coordinate calculating part 31 calculates the coordinates ($X_{5A}$, $Y_{5A}$, $Z_{5A}$) of the ground contact point P5A at the time the tooth 6*a* is new without wear, using Eq. (10) below. According to this embodiment, the coordinate value $Y_{5A}$ is zero, and the coordinate value $X_{5A}$ is equal to the coordinate value $X_{3A}$. A distance H1 is a value pre-stored in the storage device D4 or the like, and represents a distance between the bucket pin position P3A and the point on the arm surface that contacts the ground contact point P5A. The distance H1 may be either a fixed value or a variable value determined in accordance with the posture of the excavating attachment.

$$Z_{5A}=Z_{3A}-H1 \tag{10}$$

Thereafter, the coordinate calculating part 31 calculates a tip distance $L_{3A}$ between the bucket pin position P3B at the time the tooth 6*a* is new without wear and the ground contact point P5A (a bucket leading edge position P4B), using Eq. (11) below. Specifically, the coordinate calculating part 31 calculates the tip distance $L_{3A}$ based on the above-described coordinates ($X_{5A}$, $Y_{5A}$, $Z_{5A}$) of the ground contact point P5A and the coordinates ($X_{3B}$, $Y_{3B}$, $Z_{3B}$) of the bucket pin position P3B obtained by the coordinate obtaining part 51 when the tooth 6*a* is caused to contact the ground contact point P5A during the first coordinate obtaining period.

$$L_{3A}=\sqrt{(X_{5A}-X_{3B})^2+(Z_{5A}-Z_{3B})^2} \tag{11}$$

In addition, the coordinate calculating part 31 calculates the coordinates ($X_{5C}$, $Y_{5C}$, $Z_{5C}$) of the ground contact point P5C after wear of the tooth 6*a*, using Eq. (12) below. According to this embodiment, the coordinate value $Y_{5C}$ is zero, and the coordinate value $X_{5C}$ is equal to the coordinate value $X_{3C}$. Furthermore, the coordinates of the ground contact point P5C are equal to the coordinates of the ground contact point P5A. Alternatively, the coordinates of the ground contact point P5C may be different from the coordinates of the ground contact point P5A. A distance H2 is a value pre-stored in the storage device D4 or the like, and represents a distance between the bucket pin position P3C and the point on the arm surface that contacts the ground contact point P5C. The distance H2 may be either a fixed value or a variable value determined in accordance with the posture of the excavating attachment. According to this embodiment, the distance H2 is equal to the distance H1.

$$Z_{5C}=Z_{3C}-H2 \tag{12}$$

Thereafter, the coordinate calculating part 31 calculates a tip distance $L_{3B}$ between the bucket pin position P3D after wear of the tooth 6*a* and the ground contact point P5C (a bucket leading edge position P4D), using Eq. (13) below. Specifically, the coordinate calculating part 31 calculates the tip distance $L_{3B}$ based on the above-described coordinates ($X_{5C}$, $Y_{5C}$, $Z_{5C}$) of the ground contact point P5C and the coordinates ($X_{3D}$, $Y_{3D}$, $Z_{3D}$) of the bucket pin position P3D obtained by the coordinate obtaining part 51 when the tooth 6*a* is caused to contact the ground contact point P5C during the second coordinate obtaining period.

$$L_{3B}=\sqrt{(X_{5C}-X_{3D})^2+(Z_{5C}-Z_{3D})^2} \quad (13)$$

Thereafter, using the same method as the method described in FIG. 6A and FIG. 6B, the coordinate calculating part 31 calculates the coordinates of the bucket leading edge position P4 at the time the tooth 6*a* is new without wear and the coordinates of the bucket leading edge position P4 after wear of the tooth 6*a*.

Thereafter, the wear amount calculating part 32 calculates the amount of wear of the tooth 6*a* (step ST16). According to this embodiment, as described in FIG. 6A and FIG. 6B, the wear amount calculating part 32 calculates the amount of wear of the tooth 6*a* based on the coordinates of the bucket leading edge position P4 at the time the tooth 6*a* is new without wear and the coordinates of the bucket leading edge position P4 after wear of the tooth 6*a*.

Thus, by causing the end of the arm 5 to contact the ground, the operator causes the controller 30 to specify the coordinates of the ground contact point P5. Then, the operator causes the controller 30 to derive a tip distance based on the coordinates of the bucket pin position P3 that the coordinate obtaining part 51 obtains when the tooth 6*a* is caused to contact the ground contact point P5. The controller 30 derives the coordinates of the bucket leading edge position P4 based on the tip distance and the bucket angle detected by the bucket angle sensor S3. Therefore, after execution of the tip information deriving process, the controller 30 can accurately derive the coordinates of the bucket leading edge position P4 by obtaining the coordinates of the bucket pin position P3 irrespective of whether the tooth 6*a* is worn or not. Furthermore, the controller 30 can calculate the amount of wear W using the tip distances derived during the two coordinate obtaining periods.

Figure 9:
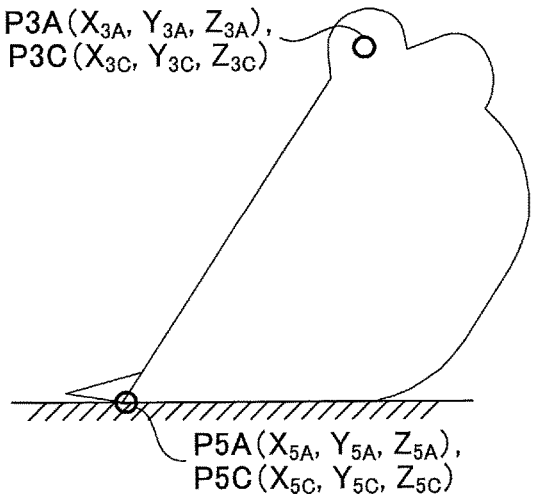
FIG. 9 is a side view of the bucket, illustrating coordinates with respect to the tip information deriving process of FIG. 7.

According to the above-described embodiment, the operator of the shovel causes the controller 30 to specify the coordinates of the ground contact point P5 by causing the end of the arm 5 to contact the ground. The present invention, however, is not limited to this configuration. For example, as illustrated in FIG. 9, the operator may cause the controller 30 to specify the coordinates of the ground contact point P5 (P5A and P5C) by causing a bucket rear surface as a non-consumable part to contact the ground. Alternatively, the operator may cause the controller 30 to specify the coordinates of the ground contact point P5 by causing a bucket link as a non-consumable part to contact the ground. A determination as to whether the ground is contacted may be based on whether a predetermined switch is operated. In this case, the operator depresses the switch in response to determining that a predetermined part of the bucket 6 has contacted the ground while watching the movement of the bucket 6. When the switch is depressed, the controller 30 determines that a predetermined part of the bucket 6 has contacted the ground to obtain the coordinates of the ground contact point P5. Alternatively, the controller 30 may determine that a predetermined part of the bucket 6 has contacted the ground to obtain the coordinates of the ground contact point P5 when the pressure of hydraulic oil in the bucket cylinder 9 exceeds a preset threshold. In the case of causing the tooth 6*a* of the bucket 6 to contact the ground, the operator may operate the attachment so that the tooth 6*a* is substantially perpendicular to the ground. In the case where the shape of the bucket 6 is input to the controller 30 beforehand, the controller 30 may automatically control the posture of the attachment so that the tooth 6*a* is substantially perpendicular to the ground.

Figure 10:
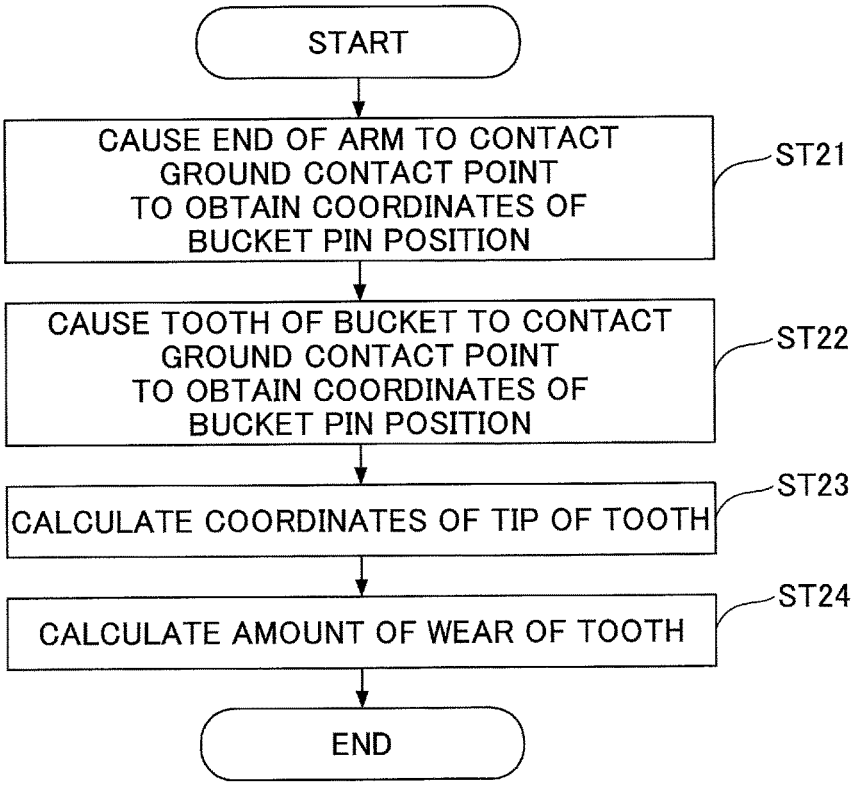
FIG. 10 is a flowchart illustrating a flow of yet another tip information deriving process.

Next, yet another tip information deriving process is described with reference to FIG. 10. FIG. 10 is a flowchart illustrating a flow of yet another tip information deriving process. The tip information deriving process of FIG. 10 is different from the tip information deriving process of FIG. 7 in calculating the coordinates of a bucket leading edge position and the amount of wear of the tooth 6*a* based on two sets of coordinates of a bucket pin position obtained during a single coordinate obtaining period. Therefore, the tip information deriving process of FIG. 10 is described with reference to FIG. 8A and FIG. 8B.

First, the coordinate calculating part 31 obtains the coordinates ($X_{3C}$, $Y_{3C}$, $Z_{3C}$) of the bucket pin position P3C that the coordinate obtaining part 51 obtains when the end of the arm 5 is caused to contact the ground contact point P5C (step ST21).

Thereafter, the coordinate calculating part 31 obtains the coordinates ($X_{3D}$, $Y_{3D}$, $Z_{3D}$) of the bucket pin position P3D that the coordinate obtaining part 51 obtains when the tip of the tooth 6*a* of the bucket 6 is caused to contact the ground contact point P5C (step ST22).

Thereafter, the coordinate calculating part 31 calculates the coordinates of the tip of the tooth 6*a* (step ST23). According to this embodiment, the coordinate calculating part 31 calculates the Z coordinate value $Z_{5C}$ of the ground contact point P5C, using Eq. (12) described above. According to this embodiment, the Y coordinate value $Y_{5C}$ is zero, and the X coordinate value $X_{5C}$ is equal to the X coordinate value $X_{3C}$ of the bucket pin position P3C.

Thereafter, the coordinate calculating part 31 calculates the tip distance $L_{3B}$ between the bucket pin position P3D and the ground contact point P5C (the bucket leading edge position P4D), using Eq. (13) described above.

Thereafter, using the same method as the method described in FIG. 6A and FIG. 6B, the coordinate calculating part 31 calculates the coordinates of the bucket leading edge position P4 after wear of the tooth 6*a*.

Thereafter, the wear amount calculating part 32 calculates the amount of wear of the tooth 6*a* (step ST24). According to this embodiment, the wear amount calculating part 32 calculates the amount of wear of the tooth 6*a* based on the pre-stored tip distance $L_{3A}$ (at the time the tooth 6*a* is new without wear) and the tip distance $L_{3B}$ calculated at step ST23. The tip distance $L_{3A}$ may be automatically set in accordance with the type of a tooth that the operator inputs beforehand.

Specifically, as illustrated in FIG. 6B, the wear amount calculating part 32 derives the coordinates ($X_{4C1}$, $Y_{4C1}$, $Z_{4c1}$) of the bucket leading edge position P4C1 at the time the tooth 6*a* is new without wear and the coordinates ($X_{4C2}$, $Y_{4C2}$, $Z_{4C2}$) of the current bucket leading edge position P4C2 with the tooth 6*a* being worn, based on the tip distance $L_{3A}$, the tip distance $L_{13}$, and the coordinates ($X_{3C}$, $Y_{3C}$, $Z_{3C}$) of the current bucket pin position P3. Then, using Eq. (9) described above, the wear amount calculating part 32 calculates the amount of wear W of the tooth 6*a* of the bucket 6.

According to this configuration, the controller 30 can derive the coordinates of the tip of the worn tooth 6*a* and its amount of wear with a lower operational load than in the tip information deriving process of FIG. 7.

Figure 11:
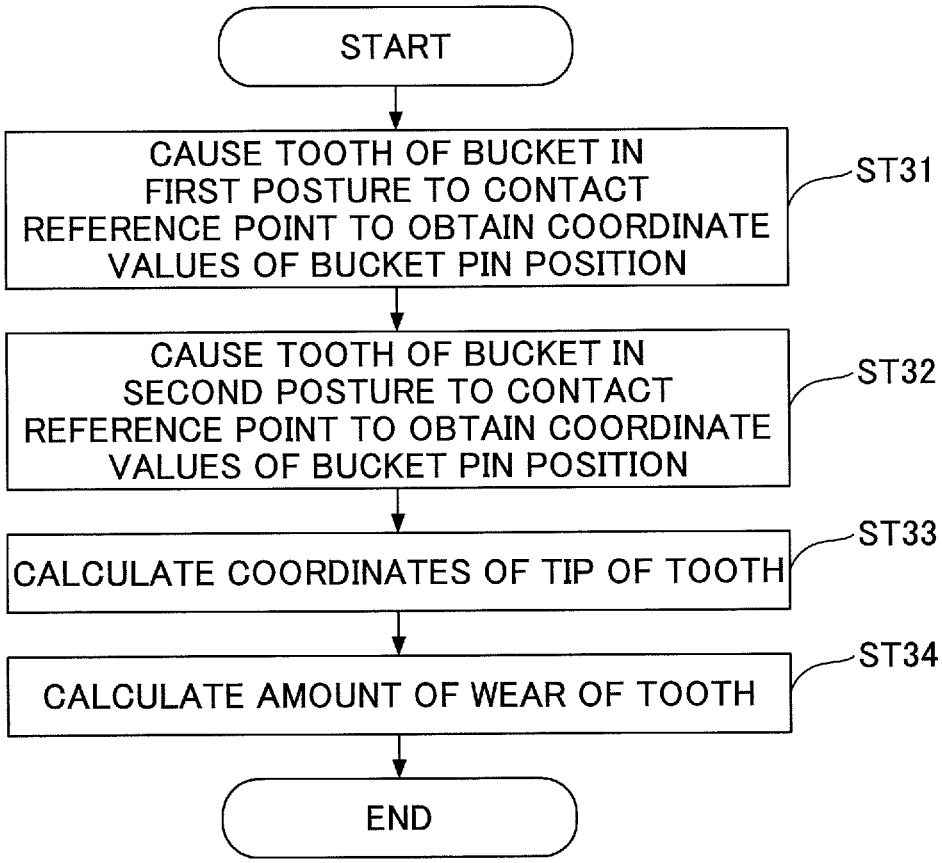
FIG. 11 is a flowchart illustrating a flow of still another tip information deriving process.
Figure 12:
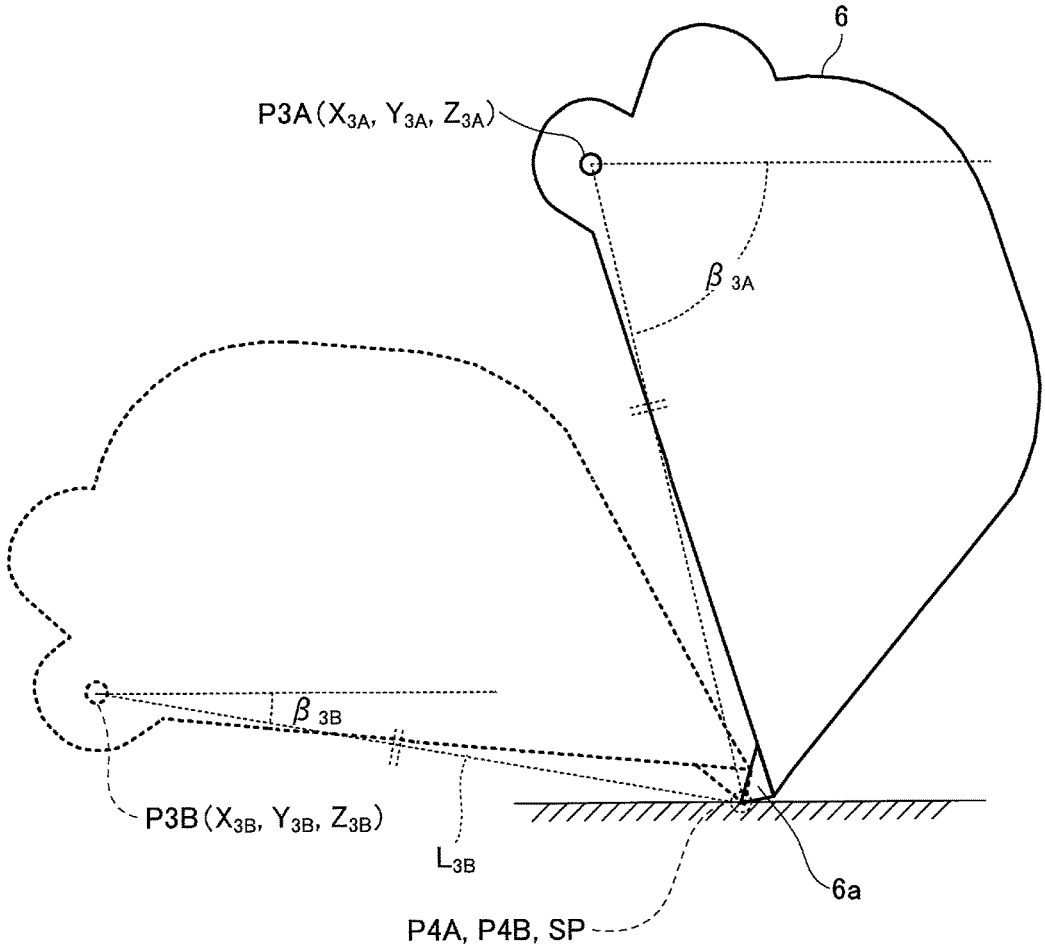
FIG. 12 is a side view of the bucket, illustrating coordinates with respect to the tip information deriving process of FIG. 11.

Next, still another tip information deriving process is described with reference to FIG. 11 and FIG. 12. FIG. 11 is a flowchart illustrating a flow of still another tip information deriving process. FIG. 12 is a side view of the bucket 6, illustrating coordinates with respect to the tip information deriving process of FIG. 11. Specifically, FIG. 12 depicts the case where the tooth 6*a* of the bucket 6 is caused to contact the same single reference point SP in two different postures. A thick solid line indicates the bucket 6 in a first posture, and a thick dotted line indicates the bucket 6 in a second posture.

First, the coordinate calculating part 31 obtains the coordinates ($X_{3A}$, $Y_{3A}$, $Z_{3A}$) of a bucket pin position P3A that the coordinate obtaining part 51 obtains when the tip of the tooth 6*a* of the bucket 6 in the first posture is caused to contact the reference point SP (step ST31).

Thereafter, the coordinate calculating part 31 obtains the coordinates ($X_{3B}$, $Y_{3B}$, $Z_{3B}$) of a bucket pin position P3B that the coordinate obtaining part 51 obtains when the tip of the tooth 6*a* of the bucket 6 in the second posture is caused to contact the reference point SP (step ST32).

Thereafter, the coordinate calculating part 31 calculates the coordinates of the tip of the tooth 6*a* (step ST33). According to this embodiment, the coordinate calculating part 31 calculates a tip distance $L_{3B}$ between the bucket pin position P3A or the bucket pin position P3B and the reference point SP (a bucket leading edge position P4A) based on the coordinates ($X_{3A}$, $Y_{3A}$, $Z_{3A}$) of the bucket pin position P3A, the coordinates ($X_{3B}$, $Y_{3B}$, $Z_{3B}$) of the bucket pin position P3B, and the fact that the length of a line segment P3A-SP is equal to the length of a line segment P3B-SP, using Eq. (14) below. Then, the coordinate calculating part 31 calculates the coordinates of the tip of the tooth 6*a* based on the coordinates of the bucket pin position P3A or the bucket pin position P3B, the bucket angle detected by the bucket angle sensor S3, and the tip distance $L_{3B}$.

$$L_{3B} = \frac{\sqrt{(X_{3A} - X_{3B})^2 + (Z_{3A} - Z_{3B})^2}}{2 \times \sin\left(\frac{\beta_{3A} - \beta_{3B}}{2}\right)} \tag{14}$$

The X coordinate value of a reference point that the tip of the tooth 6*a* of the bucket 6 in the first posture is caused to contact may be different from the X coordinate value of a reference point that the tip of the tooth 6*a* of the bucket 6 in the second posture is caused to contact. That is, the two reference points may be at different positions in a horizontal plane at the same height.

Thereafter, the wear amount calculating part 32 calculates the amount of wear of the tooth 6*a* (step ST34). According to this embodiment, the wear amount calculating part 32 calculates the amount of wear of the tooth 6*a* based on the pre-stored tip distance $L_{3A}$ (at the time the tooth 6*a* is new without wear) and the tip distance $L_{3B}$ calculated at step ST33.

Figure 13:
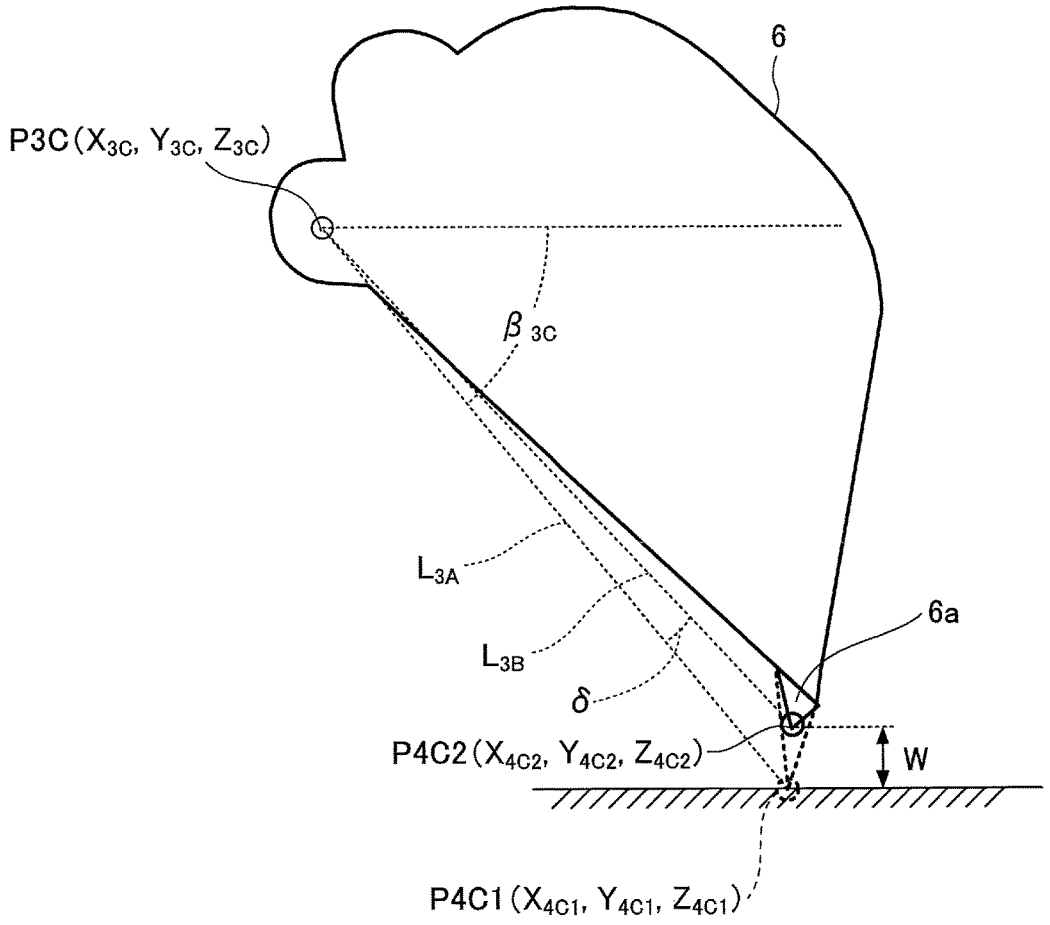
FIG. 13 is a side view of the bucket, illustrating coordinates with respect to a wear amount calculating process.

Specifically, as illustrated in FIG. 13, the wear amount calculating part 32 derives the coordinates $X_{4C1}$ $Y_{4C1}$, $Z_{4C1}$) of the bucket leading edge position P4C1 at the time the tooth 6*a* is new without wear and the coordinates ($X_{4C2}$, $Y_{4C2}$, $Z_{4C2}$) of the current bucket leading edge position P4C2 with the tooth 6*a* being worn, based on the tip distance $L_{3A}$, the tip distance $L_{3B}$, and the coordinates ($X_{3C}$, $Y_{3C}$, $Z_{3C}$) of the current bucket pin position P3C. Then, using Eq. (9) described above, the wear amount calculating part 32 calculates the amount of wear W of the tooth 6*a* of the bucket 6. FIG. 13 is a side view of the bucket 6, illustrating coordinates with respect to a wear amount calculating process of calculating the amount of wear W by the wear amount calculating part 32. In the case of FIG. 13, the controller 30 causes the tip of the tooth 6*a* to contact the ground by automatically controlling the posture of the excavating attachment so that the extending direction of the tooth 6*a* is perpendicular to the ground (a horizontal plane). Therefore, the controller 30 can calculate the amount of wear W by only calculating a difference between the Z coordinate value $Z_{4C1}$ of the bucket leading edge position P4C1 and the Z coordinate value $Z_{4C2}$ of the bucket leading edge position P4C2.

According to this configuration, the controller 30 can derive the coordinates of the tip of the worn tooth 6*a* and its amount of wear with a lower operational load than in the tip information deriving process of FIG. 7.

Figure 14:
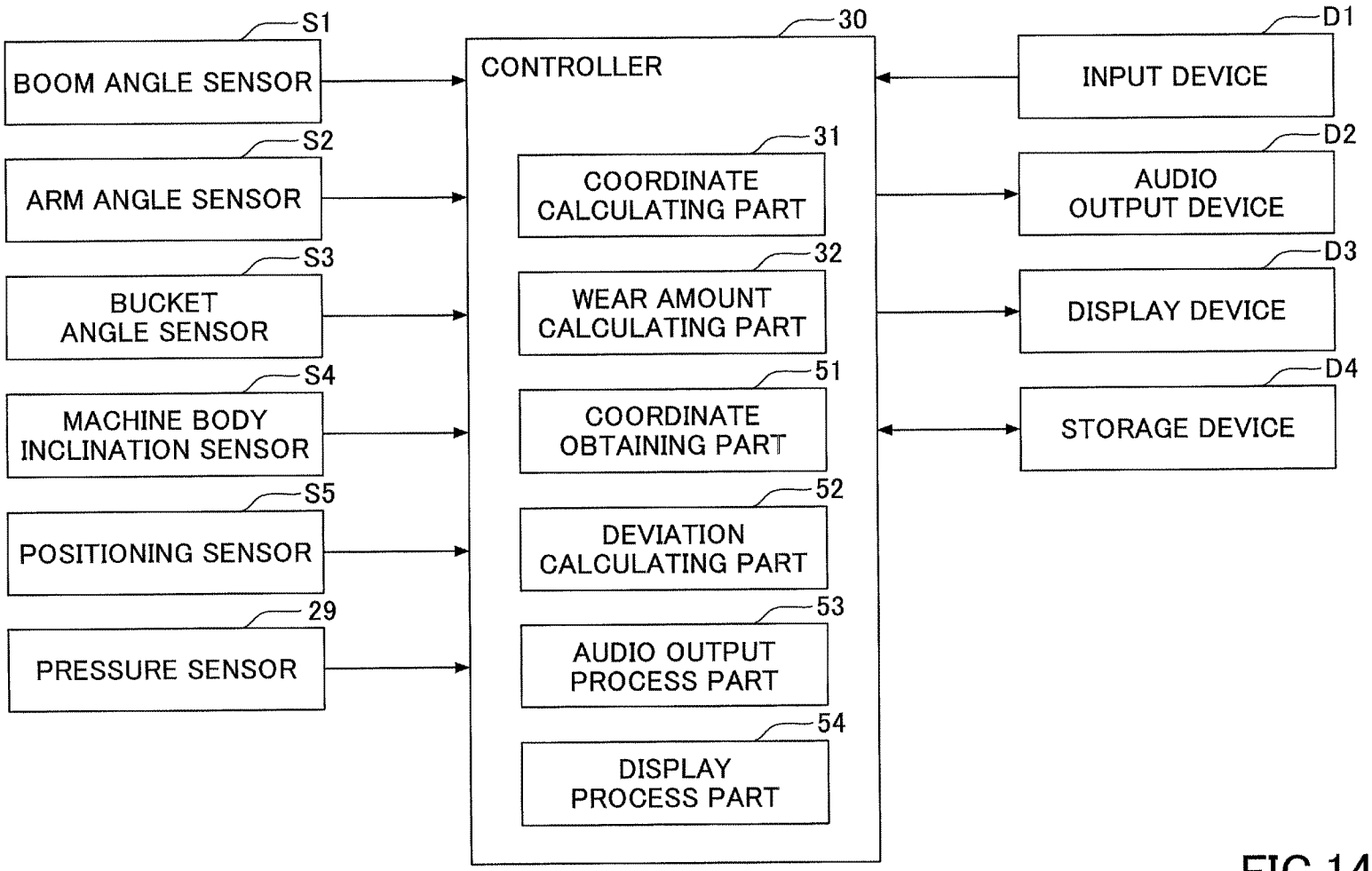
FIG. 14 is a functional block diagram illustrating another arrangement of the controller.

Next, another arrangement of the controller 30 is described with reference to FIG. 14. FIG. 14 is a functional block diagram illustrating another arrangement of the controller 30.

The arrangement of FIG. 14 is different from the arrangement of FIG. 3 in that the machine guidance device 50 is integrated into the controller 30 from, but is equal to the arrangement of FIG. 3 in the functions of the components.

According to the arrangement of FIG. 14, all of the four functional elements of the coordinate obtaining part 51, the deviation calculating part 52, the audio output process part 53, and the display process part 54 of the machine guidance device 50 are integrated into the controller 30. Alternatively, only part of the four functional elements may be integrated into the controller 30. In this case, the machine guidance device 50 including the remaining unintegrated part of the four functional elements is connected to the controller 30.

According to this arrangement, the controller 30 of FIG. 14 can achieve the same effects as the controller 30 of FIG. 3.

A description is given above of tip information deriving processes. By implementing one of these tip information deriving processes, a shovel operator can easily measure the amount of wear of the tooth 6*a* of the bucket 6 with no need for a special tool.

Furthermore, the operator can receive machine guidance based on the coordinates of the bucket leading edge position P4 that corresponds to the tip of the worn tooth 6*a*. Therefore, it is possible to improve the finishing accuracy of a worked surface.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

For example, according to the above-described embodiment, the ground contact point P5 is a point on the ground. The present invention, however, is not limited to this configuration. Specifically, the ground contact point P5 may be any feature that can be contacted by both a non-consumable part and a consumable part (the tooth 6*a*) of the excavating attachment, and may be, for example, a point on a surface of a vertical wall.

Furthermore, according to the above-described embodiment, the reference point SP is a point on the ground. The present invention, however, is not limited to this configuration. Specifically, the reference point SP may be any feature that can be contacted by a consumable part (the tooth 6*a*) of the excavating attachment, and may be, for example, a point on a surface of a vertical wall.

Furthermore, the reference point RP, the ground contact point P5, and the reference point SR do not have to be actual points, and may be virtual points that are optically, magnetically, or electrically set.

Furthermore, according to the above-described embodiment, by rotating a reference coordinate system based on the shovel to match the three axes of the reference coordinate system to the three axes of the World Geodetic System, the coordinate obtaining part 51 derives coordinates in the World Geodetic System corresponding to a point in the reference coordinate system. For example, the coordinate obtaining part 51 derives coordinates (latitude, longitude, and altitude) in global geodetic systems such as the World Geodetic System 1984, the Japanese Geodetic Datum 2000, and the International Terrestrial Reference System. The coordinate obtaining part 51 may also derive coordinates of geodetic systems that are narrower in range, such as local coordinate systems (regional coordinate systems).

Figure 15:
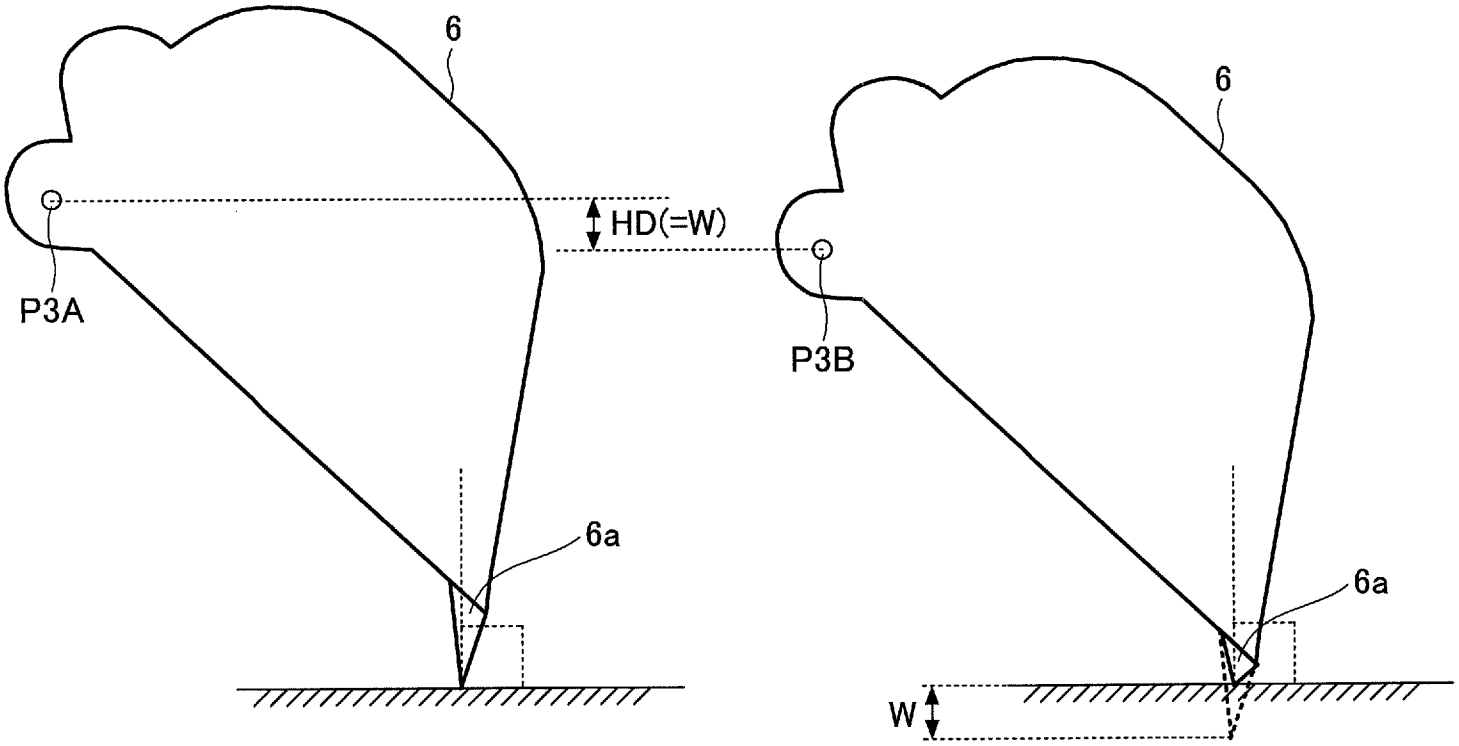
FIG. 15 is a side view of the bucket, illustrating another wear amount calculating process.

Furthermore, according to the above-described embodiment, the wear amount calculating part 32 calculates the amount of wear of the tooth 6*a* of the bucket 6 regardless of whether the angle of the extending direction of the tooth 6*a* relative to the ground (a horizontal plane) is known or not. When the angle of the extending direction of the tooth 6*a* relative to the ground (a horizontal plane) is known, however, the wear amount calculating part 32 can more easily calculate the amount of wear of the tooth 6*a*. For example, when information on the shape of the bucket 6 is input to the controller 30 in advance through the input device D1 or the like, the controller 30 can control the angle of the extending direction of the tooth 6*a* relative to the ground (a horizontal plane). Specifically, when the operator operates the excavating attachment to cause the tooth 6*a* of the bucket 6 to contact the ground (a horizontal plane), the controller 30 automatically controls the degree of opening or closing of the bucket 6 to cause the extending direction of the tooth 6*a* to be perpendicular to the ground (a horizontal plane). In this case, as illustrated in FIG. 15, the controller 30 calculates a difference HD between the height (Z coordinate value) of a bucket pin position P3A and the height (Z coordinate value) of a bucket pin position P3B as the amount of wear W. The bucket pin position P3A is a bucket pin position at the time the tooth 6*a* is caused to perpendicularly contact the ground (a horizontal plane) when the tip of the tooth 6*a* is unworn, and the bucket pin position P3B is a bucket pin position at the time the tooth 6*a* is caused to perpendicularly contact the same ground (horizontal plane) when the tip of the tooth 6*a* is worn. Thus, when it is possible to cause the tooth 6*a* to perpendicularly contact the ground (a horizontal plane), the controller 30 can calculate the amount of wear of the tooth 6*a* based only on a change in the height of the bucket pin position.

What is claimed is:

1. A shovel comprising:

a lower-part traveling body;

an upper-part turning body turnably mounted on the lower-part traveling body;

an attachment mounted on the upper-part turning body, the attachment having a consumable part attached to a leading edge thereof; and a controller configured to obtain coordinates of the consumable part when the consumable part is caused to contact a predetermined feature, and to calculate an amount of wear of the consumable part based on at least two sets of the coordinates obtained under different conditions.

2. The shovel as claimed in claim 1, wherein the controller is configured to obtain coordinates of a predetermined part of the attachment based on a position of the shovel and a posture of the attachment; and calculate the amount of wear of the consumable part based on the at least two sets of the coordinates obtained under the different conditions.

3. The shovel as claimed in claim 2, wherein the at least two sets of the coordinates include the coordinates obtained by the controller during a first coordinate obtaining period and the coordinates obtained by the controller during a second coordinate obtaining period.

4. The shovel as claimed in claim 2, wherein the at least two sets of the coordinates include the coordinates obtained by the controller when a tip of the consumable part is placed at a predetermined position during a first coordinate obtaining period and the coordinates obtained by the controller when the tip of the consumable part is placed at the predetermined position during a second coordinate obtaining period.

5. The shovel as claimed in claim 2, wherein the controller is configured to calculate the amount of wear of the consumable part based on the coordinates of a predetermined part of a non-consumable part of the attachment obtained by the controller when the predetermined part of the non-consumable part is caused to contact a first predetermined feature during a first coordinate obtaining period, the coordinates of the predetermined part of the attachment obtained by the controller when the consumable part is caused to contact the first predetermined feature during the first coordinate obtaining period, the coordinates of the predetermined part of the non-consumable part of the attachment obtained by the controller when the predetermined part of the non-consumable part is caused to contact a second predetermined feature during a second coordinate obtaining period, and the coordinates of the predetermined part of the attachment obtained by the controller when the consumable part is caused to contact the second predetermined feature during the second coordinate obtaining period.

6. The shovel as claimed in claim 2, wherein the at least two sets of the coordinates include the coordinates obtained by the controller when the attachment is in a first posture and the coordinates include the coordinates obtained by the controller when the attachment is in a second posture different from the first posture.

7. The shovel as claimed in claim 6, wherein the controller is configured to calculate the amount of wear of the consumable part based on the coordinates of a predetermined part of a non-consumable part of the attachment obtained by the controller when the predetermined part of the non-consumable part is caused to contact the predetermined feature in the first posture and the coordinates of the predetermined part of the attachment obtained by the controller when the consumable part is caused to contact the predetermined feature in the second posture.

8. The shovel as claimed in claim 6, wherein the first posture is different from the second posture in at least a posture of the consumable part.

9. A method of controlling a shovel including a lower-part traveling body, an upper-part turning body turnably mounted on the lower-part traveling body, an attachment mounted on the upper-part turning body, the attachment having a consumable part attached to a leading edge thereof, and a controller configured to obtain coordinates of the consumable part when the consumable part is caused to contact a predetermined feature, the method comprising:

calculating, by the controller, an amount of wear of the consumable part based on at least two sets of the coordinates obtained under different conditions.

10. The method of controlling a shovel as claimed in claim 9, further comprising:

obtaining, by the controller, coordinates of a predetermined part of the attachment based on a position of the shovel and a posture of the attachment.

11. The method of controlling a shovel as claimed in claim 9, wherein the at least two sets of the coordinates include the coordinates obtained during a first coordinate obtaining period and the coordinates obtained during a second coordinate obtaining period.

12. The method of controlling a shovel as claimed in claim 9, wherein the at least two sets of the coordinates include the coordinates obtained when a tip of the consumable part is placed at a predetermined position during a first coordinate obtaining period and the coordinates obtained when the tip of the consumable part is placed at the predetermined position during a second coordinate obtaining period.

13. A shovel comprising:

a lower-part traveling body;

an upper-part turning body turnably mounted on the lower-part traveling body;

an attachment mounted on the upper-part turning body, the attachment having a consumable part attached to a leading edge of the attachment; and a controller configured to obtain coordinates of a predetermined part of the attachment based on a posture of the attachment, wherein the controller is configured to calculate an amount of wear of the consumable part based on the coordinates of the predetermined part of the attachment that are obtained when the consumable part attached to the leading edge of the attachment is caused to contact a predetermined feature under different conditions.

14. The shovel as claimed in claim 13, wherein the coordinates obtained under the different conditions include coordinates obtained during a first coordinate obtaining period and coordinates obtained during a second coordinate obtaining period.

15. The shovel as claimed in claim 13, wherein the coordinates obtained under the different conditions include coordinates obtained when the consumable part is placed at a predetermined position during a first coordinate obtaining period and coordinates obtained when the consumable part is placed at the predetermined position during a second coordinate obtaining period.

16. The shovel as claimed in claim 13, wherein the controller is configured to determine that the consumable part contacts ground at a predetermined position when a pressure of hydraulic oil in a cylinder exceeds a preset threshold.

17. The shovel as claimed in claim 13, wherein the coordinates of the predetermined part of the attachment correspond to a position of a pin of a bucket included in the attachment.

18. The shovel as claimed in claim 13, wherein the controller is configured to derive a deviation between a current position of a leading edge of a bucket included in the attachment and a pre-input target position.

19. The shovel as claimed in claim 13, wherein a type of the consumable part is input to the controller.

20. A shovel comprising:

a lower-part traveling body;

an upper-part turning body turnably mounted on the lower-part traveling body;

an attachment mounted on the upper-part turning body, the attachment having a consumable part attached to a leading edge of the attachment; and a controller configured to obtain coordinates of a predetermined part of the attachment based on a posture of the attachment, wherein the controller is configured to correct coordinates of the consumable part based on an amount of wear of the consumable part, the amount of wear of the consumable part being calculated using a difference between the coordinates of the predetermined part of the attachment obtained under different conditions or using a difference between coordinates of the consumable part obtained under the different conditions.

21. The shovel as claimed in claim 20, wherein a type of the consumable part is input to the controller.

* * * * *